US011002136B2

(12) United States Patent
Akami et al.

(10) Patent No.: US 11,002,136 B2
(45) Date of Patent: May 11, 2021

(54) HYDRAULIC SYSTEM

(71) Applicant: NABTESCO CORPORATION, Tokyo (JP)

(72) Inventors: Toshiya Akami, Gifu (JP); Sho Yamaguchi, Gifu (JP)

(73) Assignee: NABTESCO CORPORATION, Tokyo (JP)

( * ) Notice: Subject to any disclaimer, the term of this patent is extended or adjusted under 35 U.S.C. 154(b) by 0 days.

(21) Appl. No.: 16/549,354

(22) Filed: Aug. 23, 2019

(65) Prior Publication Data

US 2020/0072052 A1 Mar. 5, 2020

(30) Foreign Application Priority Data

Aug. 31, 2018 (JP) ..... JP2018-163909

(51) Int. Cl.
*F01B 3/00* (2006.01)
*F04B 1/2078* (2020.01)

(52) U.S. Cl.
CPC ..... *F01B 3/007* (2013.01); *F04B 1/2078* (2013.01)

(58) Field of Classification Search
CPC combination set(s) only.
See application file for complete search history.

(56) References Cited

U.S. PATENT DOCUMENTS 4,543,876 A * 10/1985 Heyl ..... F04B 1/324 417/222.1
6,048,176 A * 4/2000 Deininger ..... F04B 1/324 417/222.1
2007/0180986 A1* 8/2007 Niidome ..... F04B 1/2092 92/70
2018/0216731 A1* 8/2018 Richardson ..... F04B 1/2078

FOREIGN PATENT DOCUMENTS

EP 1760313 A1 3/2007
JP 7-103133 A 4/1995
JP 09166074 A * 6/1997
JP 2000-205119 A 7/2000
JP 2000205119 A * 7/2000
JP 2016-133074 A 7/2016
JP 2016133074 A * 7/2016

OTHER PUBLICATIONS

Extended European Search Report dated Oct. 11, 2019 issued in corresponding European Patent Application No. 19194008.9.

* cited by examiner

*Primary Examiner* — Thomas E Lazo
(74) *Attorney, Agent, or Firm* — Pillsbury Winthrop Shaw Pittman, LLP

(57) ABSTRACT

A hydraulic system includes a piston, a swash plate opposed to the piston, and a swash plate supporting member supporting the swash plate so that a tilt of the swash plate is variable. An oil reservoir portion is provided between the swash plate and the swash plate supporting member, the oil reservoir portion communicating with a pressure oil intro- (Continued)

ducing passage. An area of the oil reservoir portion between the swash plate and the swash plate supporting member varies with the tilt of the swash plate.

8 Claims, 10 Drawing Sheets

HYDRAULIC SYSTEM

CROSS-REFERENCE TO RELATED APPLICATIONS

This application is based on and claims the benefit of priority from Japanese Patent Application Serial No. 2018-163909 (filed on Aug. 31, 2018), the contents of which are hereby incorporated by reference in their entirety.

TECHNICAL FIELD

The present invention relates to a hydraulic system including a swash plate.

BACKGROUND

A swash plate hydraulic system is known as disclosed in, for example, Japanese Patent Application Publication No. 2016-133074 (the '074 Publication). In the hydraulic system disclosed in the '074 Publication, a swash plate is opposed to a piston in an operational direction of the piston and restricts an operational range of the piston. The swash plate is supported by a swash plate supporting member so that a tilt (an orientation) thereof is variable, i.e., so that it can tilt. In this hydraulic system, a stroke of the piston can be made to vary by causing the swash plate to tilt, and thus an output from the hydraulic system can be adjusted. As disclosed in the '074 Publication, in the hydraulic system configured as above, by a working fluid (an oil) in a cylinder chamber housing the piston, the swash plate is pressed toward the swash plate supporting member via the piston. In a case where the swash plate is pressed at a high pressure toward the swash plate supporting member, a larger force is required to operate the swash plate to tilt, resulting in a failure to achieve smooth tilting of the swash plate. In the '074 Publication, in order to address this trouble and operate the swash plate smoothly, an oil reservoir portion is provided between the swash plate and the swash plate supporting member. A working fluid is supplied into the oil reservoir portion, and thus the swash plate can be pressed away from the swash plate supporting member. Moreover, in the '074 Publication, the size of a side wall of the oil reservoir portion is made to vary so as to facilitate tilting of the swash plate in one direction.

However, strength of a force required to cause the swash plate to tilt is not constant and varies with a tilt of the swash plate. For example, at the start of tilting of the swash plate, the swash plate held at a predetermined relative position to the swash plate supporting member needs to be operated with a large force larger than a static frictional force far larger than a dynamic frictional force. Furthermore, normally, a force received by the swash plate from a tilt adjustment mechanism for adjusting a tilt of the swash plate varies with the tilt of the swash plate, though depending also on a configuration of the tilt adjustment mechanism. Typically, when the swash plate is maintained in a raised state where its tilt angle is decreased, by the tilt adjustment mechanism, the swash plate is pressed with a stronger force toward the swash plate supporting member. Further, the larger the force to press the swash plate toward the swash plate supporting member, the larger a force required to cause the swash plate to tilt.

On the other hand, in the hydraulic system disclosed in the '074 Publication, strength of a force received by the swash plate from the oil reservoir portion is constant regardless of a tilt of the swash plate. When a force with which the oil reservoir portion presses the swash plate is set to be low on the assumption that a force required to cause the swash plate to tilt is low, for example, at the start of tilting of the swash plate or when the swash plate is raised as described above, smooth tilting of the swash plate cannot be achieved. At this time, hysteresis occurs in horsepower characteristics, resulting in deterioration in performance of the hydraulic system. On the other hand, when the force with which the oil reservoir portion presses the swash plate is set to be high on the assumption that the force required to cause the swash plate to tilt is high, in a case where the use of a small force is sufficient for causing the swash plate to tilt, the oil in the oil reservoir portion might leak from between the swash plate and the swash plate supporting member, also causing deterioration in performance of the hydraulic system.

SUMMARY

The present invention has been made in view of the above-described circumstances, and it is an object of the present invention to effectively suppress deterioration in performance of a hydraulic system, the deterioration being related to a tilting operation of a swash plate.

A hydraulic system according to the present invention includes a piston, a swash plate opposed to the piston, and a swash plate supporting member supporting the swash plate so that a tilt of the swash plate is variable, wherein at least one oil reservoir portion is provided between the swash plate and the swash plate supporting member, the at least one oil reservoir portion communicating with a pressure oil introducing passage, and wherein an area of the at least one oil reservoir portion between the swash plate and the swash plate supporting member varies with the tilt of the swash plate.

In the hydraulic system according to the present invention, it is possible that a first concave portion is formed in a surface of the swash plate facing the swash plate supporting member, the first concave portion forming the at least one oil reservoir portion, a second concave portion is formed in a surface of the swash plate supporting member facing the swash plate, the second concave portion forming the at least one oil reservoir portion, and an area of a region in which the first concave portion and the second concave portion overlap with each other varies with the tilt of the swash plate.

In the hydraulic system according to the present invention, it is possible that an area of the at least one oil reservoir portion in a largest tilt state where a tilt angle of the swash plate is largest is larger than an area of the at least one oil reservoir portion in an intermediate state between a smallest tilt state where the tilt angle is smallest and the largest tilt state, the tilt angle of the swash plate being relative to a plane perpendicular to an operational direction of the piston.

In the hydraulic system according to the present invention, it is possible that an area of the at least one oil reservoir portion in a smallest tilt state where a tilt angle of the swash plate is smallest is larger than an area of the at least one oil reservoir portion in an intermediate state between a largest tilt state where the tilt angle is largest and the smallest tilt state, the tilt angle of the swash plate being relative to a plane perpendicular to an operational direction of the piston.

In the hydraulic system according to the present invention, it is possible that an area of the at least one oil reservoir portion in an intermediate state between a smallest tilt state where a tilt angle of the swash plate is smallest and a largest tilt state where the tilt angle is largest is smaller than at least one of an area of the at least one oil reservoir portion in the smallest tilt state and an area of the at least one oil reservoir portion in the largest tilt state, the tilt angle of the swash plate being relative to a plane perpendicular to an operational direction of the piston.

In the hydraulic system according to the present invention, it is possible that an area of the at least one oil reservoir portion in an intermediate state between a smallest tilt state where a tilt angle of the swash plate is smallest and a largest tilt state where the tilt angle is largest is smaller than both of an area of the at least one oil reservoir portion in the smallest tilt state and an area of the at least one oil reservoir portion in the largest tilt state, the tilt angle of the swash plate being relative to a plane perpendicular to an operational direction of the piston.

In the hydraulic system according to the present invention, it is possible that the swash plate supporting member includes a pair of supporting portions spaced from each other, the swash plate includes a pair of supported portions supported by the pair of supporting portions of the swash plate supporting member, respectively, the at least one oil reservoir portion comprises a first oil reservoir portion and a second oil reservoir portion, the first oil reservoir portion is formed between one of the pair of supporting portions and one of the pair of supported portions, and the second oil reservoir portion is formed between the other of the pair of supporting portions and the other of the pair of supported portions.

In the hydraulic system according to the present invention, it is possible that an area of the first oil reservoir portion formed between the one of the pair of supporting portions and the one of the pair of supported portions is smaller than an area of the second oil reservoir portion formed between the other of the pair of supporting portions and the other of the pair of supported portions.

In the hydraulic system according to the present invention, it is possible that a first concave portion is formed in a surface of the swash plate facing the swash plate supporting member, the first concave portion forming the at least one oil reservoir portion, a second concave portion is formed in a surface of the swash plate supporting member facing the swash plate, the second concave portion forming the at least one oil reservoir portion, and the first concave portion and the second concave portion are spaced apart from each other in accordance with the tilt of the swash plate.

A second hydraulic system according to the present invention includes a piston, a swash plate opposed to the piston, and a swash plate supporting member supporting the swash plate so that a tilt of the swash plate is variable, the swash plate supporting member including a second concave portion provided so that an area of a region in which the second concave portion overlaps with a first concave portion varies with the tilt of the swash plate, the first concave portion being provided in the swash plate.

According to the present invention, it is possible to effectively suppress deterioration in performance of a hydraulic system, the deterioration being related to a tilting operation of a swash plate.

DESCRIPTION OF EXAMPLE EMBODIMENTS

Figure 1:
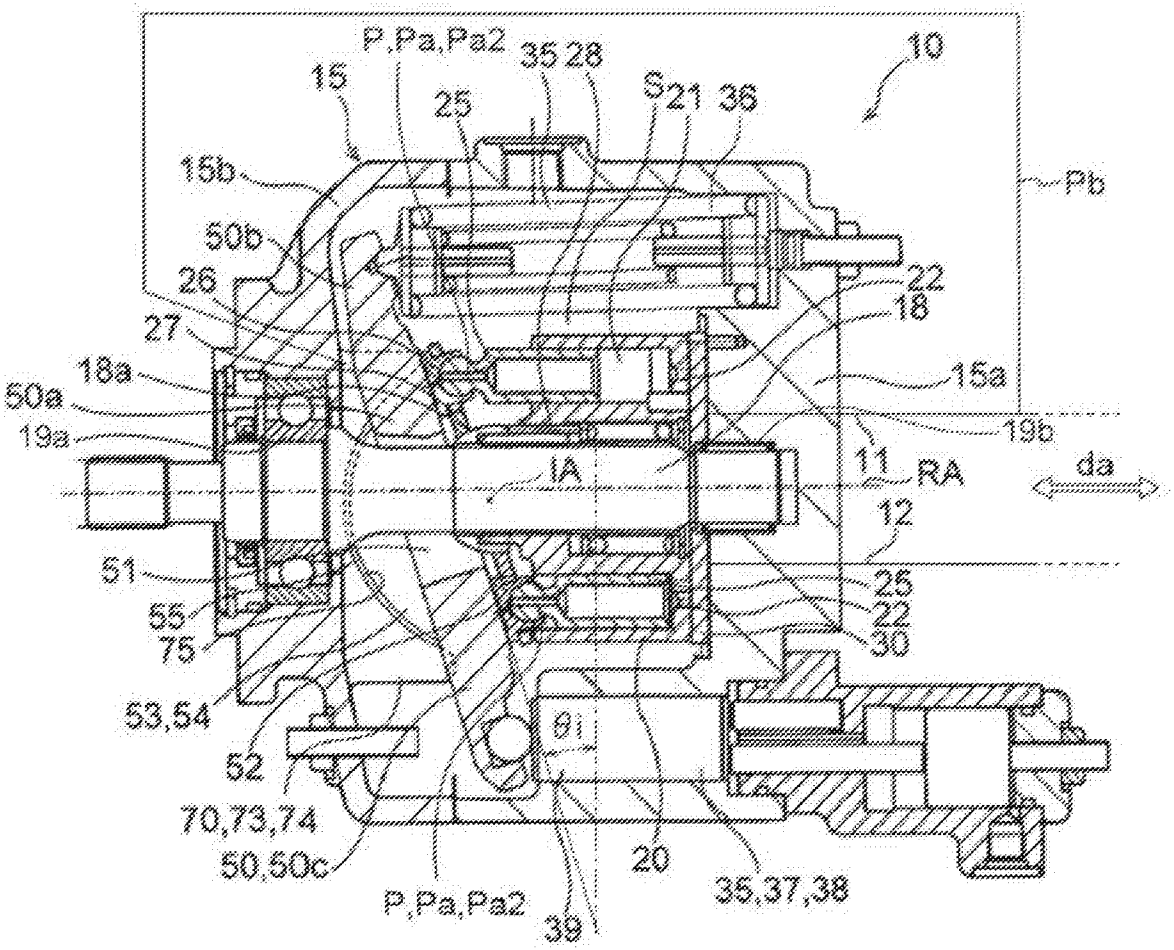
FIG. 1 is a longitudinal sectional view showing one example of a hydraulic system for explaining an embodiment according to the present invention.

Hereinafter, an embodiment of the present invention will be described with reference to the appended drawings. Some of components shown in the drawings may be shown to be different in size, scale, and so on from actual ones for easier understanding.

A hydraulic system 10 described below is a so-called variable displacement type swash plate piston pump/motor and can be used as an actuator for both of a pump and a motor. In a case where the hydraulic system 10 is used as a hydraulic pump, the hydraulic system 10 sucks a hydraulic oil into after-mentioned cylinder chambers 21 and discharges the hydraulic oil from the cylinder chambers 21. On the other hand, in a case where the hydraulic system 10 is used as a hydraulic motor, the hydraulic system 10 outputs rotation of an after-mentioned rotary shaft member 18. More specifically, in the case where the hydraulic system 10 according to the embodiment described below is used as the pump, power from a power source such as an engine causes the rotary shaft member 18 to rotate so as to cause rotation of a cylinder block 20 connected to the rotary shaft member 18 by spline connection or the like, and this rotation of the cylinder block 20 causes pistons 25 to reciprocate. In accordance with the reciprocation of the pistons 25, a hydraulic oil is sucked into some of the cylinder chambers 21 and is also discharged from the other cylinder chambers 21, thereby accomplishing an operation of the hydraulic pump. On the other hand, in the case where the hydraulic system 10 is used as the motor, power from a power source causes a hydraulic oil to flow into some of the cylinder chambers 21 and also causes the hydraulic oil to be discharged from the other cylinder chambers 21, thus causing the pistons 25 to slidably rotate on a swash plate while reciprocating. As the pistons 25 operate, the cylinder block 20 and the rotary shaft member 18 also rotate, and thus an operation of the hydraulic motor can be accomplished by utilizing rotation of the rotary shaft member 18. Typically, the hydraulic system 10 can be used as a hydraulic circuit or a driver included in a construction machine. The hydraulic system 10, however, may also be applied to other applications without being particularly limited in application.

The hydraulic system 10 shown to be of a swash plate type includes, as principal constituent components, a case 15, the rotary shaft member 18, the cylinder block 20, the pistons 25, a valve plate 30, a tilt adjustment mechanism 35, and a swash plate 50. The following describes the constituent components.

As shown in FIG. 1, the case 15 includes a first case block 15*a* and a second case block 15*b* secured to the first case block 15*a*. The first case block 15*a* and the second case block 15*b* are secured to each other by use of a fastener such as a bolt. The case 15 forms a housing space S inside thereof. The cylinder block 20, the pistons 25, the valve plate 30, the tilt adjustment mechanism 35, and the swash plate 50 are arranged in the housing space S.

In an example shown, the valve plate 30 is disposed on an inner side of the first case block 15*a*. In the first case block 15*a*, a first flow passage 11 and a second flow passage 12 are formed that communicate with the cylinder chambers 21 in the cylinder block 20 via the valve plate 30. In the drawing, for the sake of convenience of explanation, the first flow passage 11 and the second flow passage 12 are shown by lines. In reality, however, the first flow passage 11 and the second flow passage 12 have inner diameters suitable for supplying a hydraulic oil to and discharging the hydraulic oil from the cylinder chambers 21 in the cylinder block 20. The first flow passage 11 and the second flow passage 12 are provided to penetrate the case 15 from inside the case 15 to outside the case 15. The first flow passage 11 and the second flow passage 12 communicate with an actuator, a hydraulic source, and so on provided outside the hydraulic system 10.

The rotary shaft member 18 is rotatably supported to the case 15 via bearings 19*a* and 19*b*. The rotary shaft member 18 can rotate about a center axis thereof as a rotation axis RA. One end of the rotary shaft member 18 is rotatably supported by the first case block 15*a* via the bearing 19*b*. The other end of the rotary shaft member 18 is rotatably supported by the second case block 15*b* via the bearing 19*a* and extends to outside the case 15 through a through hole provided in the second case block 15*b*. In an area in which the rotary shaft member 18 penetrates the case 15, a seal member is provided between the case 15 and the rotary shaft member 18 so as to prevent a hydraulic oil from leaking to outside the case 15. A part of the rotary shaft member 18 extending from the case 15 is connected to an input unit such as, for example, a motor or an engine.

The cylinder block 20 has a columnar or cylindrical shape about the rotation axis RA. The cylinder block 20 is penetrated by the rotary shaft member 18. The cylinder block 20 is connected to the rotary shaft member 18 by, for example, spline connection. Accordingly, the cylinder block 20 can rotate about the rotation axis RA in synchronization with the rotary shaft member 18.

A plurality of cylinder chambers 21 are formed in the cylinder block 20. The plurality of cylinder chambers 21 are arranged at regular intervals along a circumferential direction about the rotation axis RA. Each of the cylinder chambers 21 extends in an axis direction da parallel to the rotation axis RA and is open toward the swash plate 50. Furthermore, connection ports 22 are formed so as to correspond to the cylinder chambers 21, respectively. Each of the connection ports 22 opens a corresponding one of the cylinder chambers 21 toward the valve plate 30 in the axis direction da.

Furthermore, the pistons 25 are provided so as to correspond to the cylinder chambers 21, respectively. Each of the pistons 25 is partly disposed in a corresponding one of the cylinder chambers 21. Each of the pistons 25 extends in the axis direction da from a corresponding one of the cylinder chambers 21 toward the swash plate 50. The pistons 25 can move in the axis direction da relative to the cylinder block 20. That is, each of the pistons 25 can advance toward the swash plate 50 in the axis direction da so as to increase a volume of a corresponding one of the cylinder chambers 21. Furthermore, each of the pistons 25 can retract toward the valve plate 30 in the axis direction da so as to decrease a volume of a corresponding one of the cylinder chambers 21.

Figure 2:
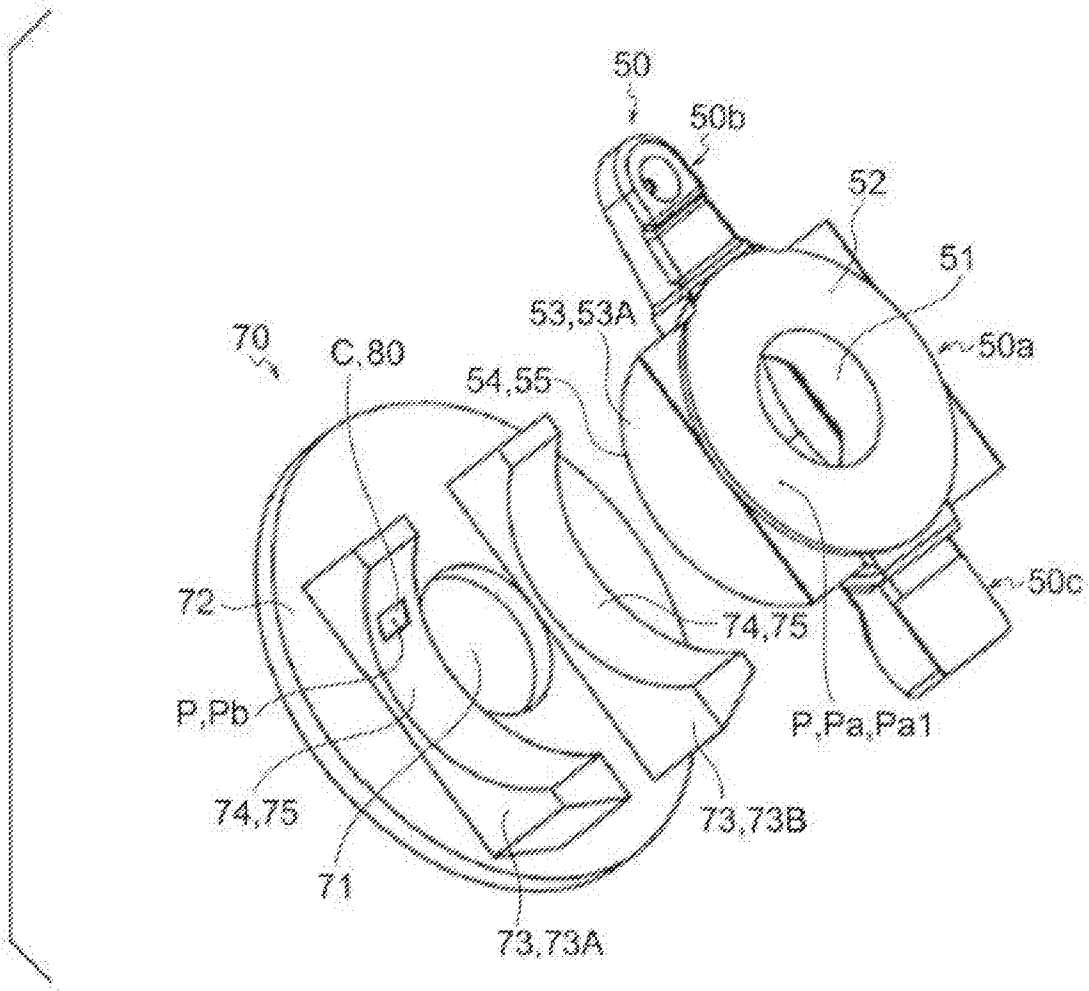
FIG. 2 is an exploded perspective view showing a swash plate and a swash plate supporting member applicable to the hydraulic system shown in FIG. 1.
Figure 3:
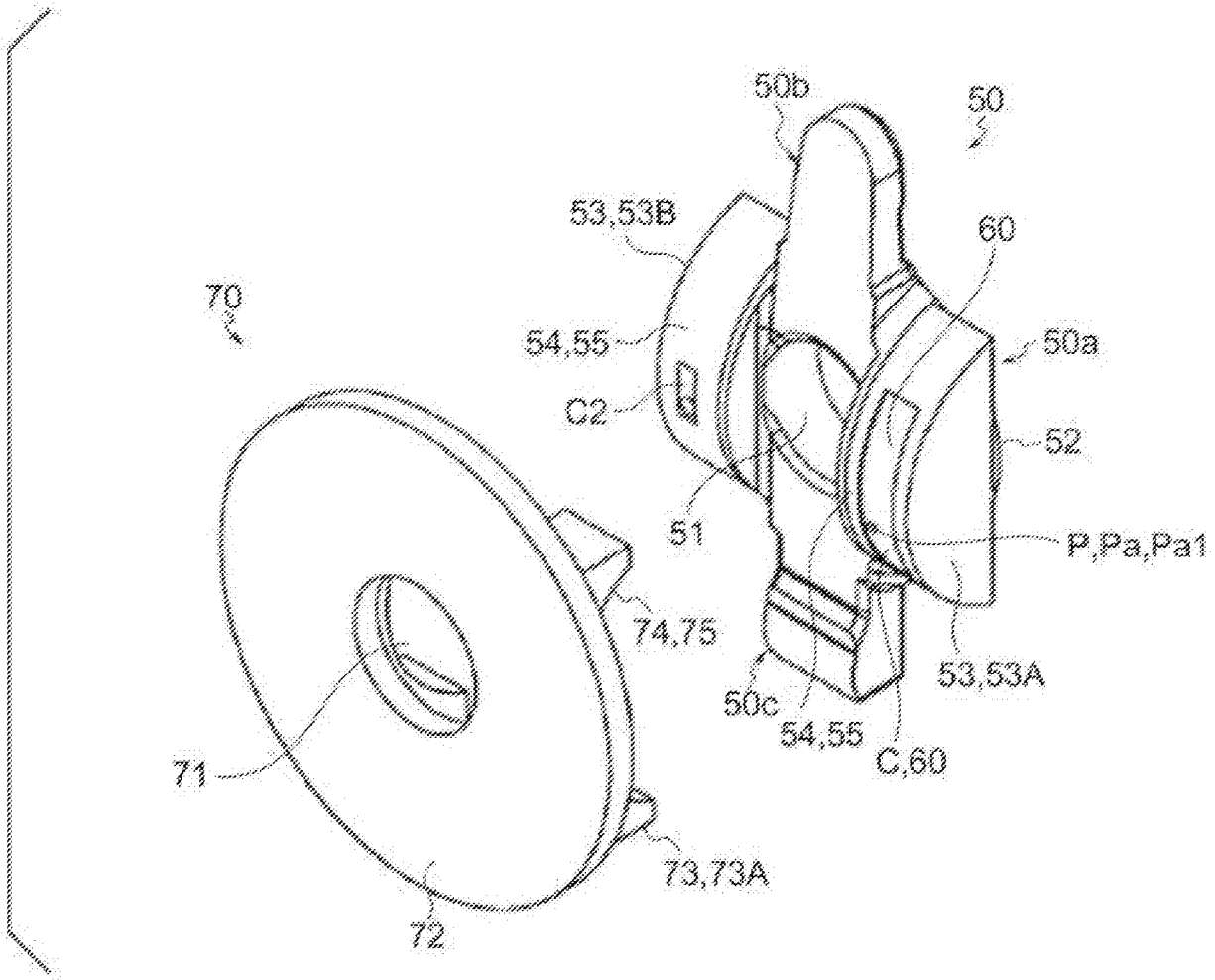
FIG. 3 is an exploded perspective view showing, from a different direction, the swash plate and the swash plate supporting member shown in FIG. 2.

The swash plate 50 is supported in the case 15. The swash plate 50 is opposed to the cylinder block 20 and the pistons 25 in the axis direction da. FIG. 2 and FIG. 3 show the swash plate 50 together with a swash plate supporting member 70 supporting the swash plate 50. The rotary shaft member 18 penetrates a central through hole 51 of the swash plate 50. The swash plate 50 has a principal surface 52 (see FIG. 2) at a position thereon at which the swash plate 50 is opposed to the cylinder block 20 and the pistons 25. The swash plate 50 is supported in the case 15 so that the principal surface 52 can tilt relative to a plane perpendicular to the rotation axis RA. A configuration for holding the swash plate 50 will be described later.

As shown in FIG. 1, shoes 26 are provided on the principle surface 52 of the swash plate 50. Each of the shoes 26 holds a head portion of a corresponding one of the pistons 25. In a specific configuration, the head portion of each of the pistons 25 at one end thereof is formed in a spherical shape. Each of the shoes 26 has a hole capable of housing substantially one-half of the spherical head portion. Each of the shoes 26 holding the head portion of a corresponding one of the pistons 25 is slidable on the principal surface 52 of the swash plate 50.

The hydraulic system 10 further includes a retainer plate 27 disposed in the case 15. The retainer plate 27 is a ring-shaped and plate-shaped member. The retainer plate 27 is penetrated by the rotary shaft member 18 and is supported on the rotary shaft member 18. A supporting part 18*a* of the rotary shaft member 18 is formed in the shape of a curved surface, the supporting part 18*a* supporting the retainer plate 27. Therefore, in a state where the retainer plate 27 is supported on the rotary shaft member 18, an orientation of the retainer plate 27 can be changed. As shown in FIG. 1, the plate-shaped retainer plate 27 is in contact with the shoes 26 while tilting along the principal surface 52 of the swash plate 50.

Furthermore, a piston pressing member 28 formed of a spring or the like is provided between the rotary shaft member 18 and the retainer plate 27. By the piston pressing member 28, the retainer plate 27 is pressed toward the swash plate 50 in the axis direction da. As a result, the retainer plate 27 can press the shoes 26 and the pistons 25 toward the principal surface 52 of the swash plate 50. Furthermore, by the piston pressing member 28, the rotary shaft member 18, together with the cylinder block 20, is pressed toward the valve plate 30 in the axis direction da. As a result, the cylinder block 20 is pressed toward the valve plate 30.

As described above, the valve plate 30 is secured to the first case block 15*a*. That is, while the cylinder block 20 rotates together with the rotary shaft member 18, the valve plate 30 is stationary. The valve plate 30 has unshown two or more ports formed therein. Each of the ports communicates with the first flow passage 11 or the second flow passage 12. The ports are formed, for example, along a circular arc about the rotation axis RA. As the cylinder block 20 rotates, the ports sequentially face the connection ports 22 corresponding to the cylinder chambers 21, respectively. As a result, in accordance with a rotation state of the cylinder block 20, the cylinder chambers 21 can be switched in terms of its connection destination between the first flow passage 11 and the second flow passage 12.

An operation of the hydraulic system 10 will now be described. In a case where the hydraulic system 10 functions as a hydraulic pump, a rotational drive force from the unshown input unit such as a motor or an engine causes the rotary shaft member 18 to rotate about the rotation axis RA. At this time, as the cylinder block 20 rotates, each of the pistons 25 advances to protrude from the cylinder block 20 and also retracts into the cylinder block 20. Such an advancing and retracting operation of each of the pistons 25 causes a volume of a corresponding one of the cylinder chambers 21 to vary.

While one of the pistons 25 retracts from a position at which the one of the pistons 25 has advanced most from a corresponding one of the cylinder chambers 21 (a top dead point) to a position at which the one of the pistons 25 has retracted most in the corresponding one of the cylinder chambers 21 (a bottom dead point), a capacity of the corresponding one of the cylinder chambers 21 housing the one of the pistons 25 is decreased. During at least part of this period, the corresponding one of the cylinder chambers 21 housing the retracting one of the pistons 25 is connected to, for example, the first flow passage 11 via one of the unshown ports of the valve plate 30, and a hydraulic oil is discharged from the corresponding one of the cylinder chambers 21. As a high-pressure side flow passage, the first flow passage 11 is connected to an external actuator or the like.

On the other hand, while one of the pistons 25 advances from the bottom dead point to the top dead point, a capacity of a corresponding one of the cylinder chambers 21 housing the one of the pistons 25 is increased. During at least part of this period, the corresponding one of the cylinder chambers 21 housing the advancing one of the pistons 25 is connected to, for example, the second flow passage 12 via another one of the unshown ports of the valve plate 30, and a hydraulic oil is sucked into the corresponding one of the cylinder chambers 21. As a low-pressure side flow passage, the second flow passage 12 is connected to, for example, a tank storing the hydraulic oil.

In a case where the hydraulic system 10 functions as a hydraulic motor, a hydraulic oil is supplied from an unshown external pump into each of the cylinder chambers 21 of the hydraulic system 10 via, for example, the first flow passage 11 and the valve plate 30. When the hydraulic oil is supplied to one of the cylinder chambers 21, a corresponding one of the pistons 25 housed therein can advance to extend from the cylinder block 20. Therefore, one of the unshown ports of the valve plate 30 connects the one of the cylinder chambers 21 to the high-pressure side first flow passage 11, the one of the cylinder chambers 21 being situated in a path from the bottom dead point to the top dead point. Thus, the hydraulic oil is supplied from the external pump to cause the cylinder block 20 to rotate, so that a rotational power can be outputted via the rotary shaft member 18.

Another one of the unshown ports of the valve plate 30 connects one of the cylinder chambers 21 to the low-pressure side second flow passage 12, the one of the cylinder chambers 21 being situated in a path from the top dead point to the bottom dead point. Accordingly, while one of the pistons 25 retracts from the top dead point to the bottom dead point, a hydraulic oil in the corresponding one of the cylinder chambers 21 housing the one of the pistons 25 can be discharged into the second flow passage 12. The hydraulic oil discharged from the hydraulic system 10 is collected in the tank or the like connected to the second flow passage 12.

In the hydraulic system 10 configured as above, the principal surface 52 of the swash plate 50 restricts a protruding amount of each of the pistons 25 from the cylinder block 20. Accordingly, a stroke of reciprocation of each of the pistons 25 along the axis direction da is determined depending on a tilt of the swash plate 50, more strictly speaking, a value of a tilt angle θi (see FIG. 1) formed by the principal surface 52 of the swash plate 50 with a plane perpendicular to the axis direction da. Further, an output of the hydraulic system 10 can be made to vary by changing the tilt of the swash plate 50, i.e., by causing the swash plate 50 to tilt. Specifically, the larger the tilt of the swash plate 50, in other words, the larger the tilt angle θi, the larger the output of the hydraulic system 10. The smaller the tilt of the swash plate 50, in other words, the smaller the tilt angle θi, the smaller the output of the hydraulic system 10. When the principal surface 52 of the swash plate 50 is perpendicular to the axis direction da, i.e., when the tilt angle θi is 00, theoretically, it is no longer possible to obtain an output from the hydraulic system 10.

Therefore, in the hydraulic system 10 shown, the swash plate 50 is held so that it can tilt. The following describes a configuration for holding the swash plate 50 in the case 15 so that the swash plate 50 can tilt.

As shown in FIG. 1, the hydraulic system 10 includes the swash plate supporting member 70 supporting the swash plate 50 so that a tilt of the swash plate 50 can be changed, i.e., the swash plate supporting member 70 supporting the swash plate 50 so that the swash plate 50 can tilt. As shown in FIG. 2, the swash plate supporting member 70 includes a base portion 72 secured to the case 15 and a supporting portion 73 provided on the base portion 72. The base portion 72 has a central through hole 71 to be penetrated by the rotary shaft member 18. On the base portion 72, a first supporting portion 73A and a second supporting portion 73B are provided so as to interpose the central through hole 71 therebetween. The rotary shaft member 18 extends between the two supporting portions 73A and 73B. The supporting portions 73A and 73B each have a receiving concave portion 74 for receiving an after-mentioned bulge portion 54 of the swash plate 50. The receiving concave portion 74 has a shape corresponding to part of a column (for example, a semicircular column). In the example shown, the swash plate supporting member 70 is formed as a separate body from the case 15 and is secured to the case 15 via a securing member or the like. There is, however, no limitation to this example. As part of the case 15, for example, as part of the second case block 15*b*, the swash plate supporting member 70 may be formed integrally with the second case block 15*b*.

On the other hand, as shown in FIG. 1, the swash plate 50 includes a supported portion 53 to be disposed on the supporting portion 73 of the swash plate supporting member 70. As shown in FIG. 3, the supported portion 53 includes the bulge portion 54 having a shape complementary to the receiving concave portion 74. The bulge portion 54 has a shape corresponding to part of a column (for example, a semicircular column). The swash plate 50 includes a first supported portion 53A and a second supported portion 53B spaced from each other in a depth direction of the plane of FIG. 1. The rotary shaft member 18 extends between the two supported portions 53A and 53B. As shown in FIG. 2 and FIG. 3, the first supported portion 53A is supported by the first supporting portion 73A, and the second supported portion 53B is supported by the second supporting portion 73B.

In this example, the supporting portion 73 of the swash plate supporting member 70 has, in the receiving concave portion 74, a supporting surface 75 extending along a circular arc. On the other hand, the supported portion 53 of the swash plate 50 has a sliding surface 55 extending along the circular arc. In a case where the supported portion 53 is disposed in the receiving concave portion 74 of the supporting portion 73, the sliding surface 55 of the supported portion 53 makes contact with the supporting surface 75 of the supporting portion 73, in particular, makes surface contact therewith on a curved surface. In the receiving concave portion 74, the supported portion 53 slides relative to the supporting portion 73, and thus the swash plate 50 including the supported portion 53 pivots relative to the swash plate supporting member 70 about a center of the circular arc defined by the sliding surface 55 and the supporting surface 75 as a tilt axis IA (see FIG. 1). While not being particularly limited, the axis IA that is a center of a tilting operation may also be situated on the principal surface 52 of the swash plate 50. By the above-described configuration, the swash plate 50 is supported by the swash plate supporting member 70 so that a tilt of the principal surface 52 can be changed.

Furthermore, as shown in FIG. 1, the hydraulic system 10 further includes the tilt adjustment mechanism 35 for controlling a tilt of the principal surface 52 of the swash plate 50. In the example shown, the tilt adjustment mechanism 35 includes a swash plate pressing member 36 and a swash plate control device 37. The following describes the tilt adjustment mechanism 35.

The swash plate 50 shown in FIG. 2 includes a center portion 50*a*, a first force receiving portion 50*b*, and a second force receiving portion 50*c*. The center portion 50*a* is disposed between the first force receiving portion 50*b* and the second force receiving portion 50*c*. The central through hole 51, the principal surface 52, and the bulge portion 54 described above are provided in the center portion 50*a*. The first force receiving portion 50*b* and the second force receiving portion 50*c* extend from the center portion 50*a* toward opposite sides.

The swash plate pressing member 36 and the swash plate control device 37 of the tilt adjustment mechanism 35 press the swash plate 50 so that the swash plate 50 tilts in opposite directions to each other. The swash plate 50 balances a force with which the swash plate 50 is pressed by the swash plate pressing member 36 and a force with which the swash plate 50 is pressed by the swash plate control device 37, thus being held at a given tilt position. In the example shown, the swash plate pressing member 36 makes contact with the first force receiving portion 50*b* of the swash plate 50 and presses the swash plate 50 so that the swash plate 50 tilts in a counterclockwise direction in FIG. 1. The swash plate control device 37 makes contact with the second force receiving portion 50*c* of the swash plate 50 and presses the swash plate 50 so that the swash plate 50 tilts in a clockwise direction in FIG. 1.

The swash plate pressing member 36 is supported to the first case block 15*a* of the case 15. The swash plate pressing member 36 is formed of, for example, a compression spring or the like. Accordingly, the swash plate pressing member 36 presses the swash plate 50 by using its resilience based on a deformation force thereof.

On the other hand, the swash plate control device 37 is configured as an adjustment actuator 38 and includes a control piston 39. The control piston 39 is capable of approaching the swash plate 50 along the axis direction da (advancement) and separating from the swash plate 50 along the axis direction da (retraction). The control piston 39 presses the second force receiving portion 50*c* of the swash plate 50. The control piston 39 is driven by, for example, a hydraulic pressure. Further, a force with which the control piston 39 presses the second force receiving portion 50*c* can be adjusted That is, a force outputted by the swash plate control device 37 is adjusted, and thus the tilt angle θi of the swash plate 50 can be controlled. The tilt angle θi refers to an angle at which the swash plate 50 tilts relative to the plane perpendicular to the axis direction da that is an operational direction of the pistons 25, namely, an angle formed by the principal surface 52 of the swash plate 50 with the plane perpendicular to the axis direction da (see FIG. 1).

In the example shown, in a case where there is no output from the swash plate control device 37, the tilt angle θi becomes largest, and the swash plate 50 shown in FIG. 1 is brought into a largest tilt state. When the control piston 39 of the swash plate control device 37 presses the second force receiving portion 50*c* of the swash plate 50, the swash plate 50 is raised from the largest tilt state, so that the tilt angle θi can be decreased. Furthermore, when the swash plate 50 is pressed with a larger force by the swash plate control device 37, the swash plate 50 is raised further, so that the tilt angle θi is 0° or has a smallest angle value close to 0°.

In the typical example shown, the swash plate 50 can tilt from the largest tilt state shown in FIG. 1 to a raised state, and it is, therefore, not intended that the swash plate 50 tilts beyond the raised state to an opposite side to the state shown in FIG. 1. Accordingly, in the typical example shown, the raised state where the tilt angle is 0° is a smallest tilt state. Further, in the above-described example, when passing above a region overlapping in the axis direction da with one of the supported portions 53A and 53B (in the example shown, the first supported portion 53A) on the principal surface 52 of the swash plate 50, each of the cylinder chambers 21 becomes high in pressure, and when passing above a region overlapping in the axis direction da with the other of the supported portions 53A and 53B (in the example shown, the second supported portion 53B) on the principal surface 52 of the swash plate 50, the each of the cylinder chambers 21 becomes low in pressure.

During an operation of the hydraulic system 10, the swash plate 50 is pressed toward the swash plate supporting member 70 by a pressure of a hydraulic oil in the cylinder chambers 21 housing the pistons 25. In the example shown, the high-pressure side first supported portion 53A is pressed with a stronger force toward the first supporting portion 73A, and the low-pressure side second supported portion 53B is pressed with a less strong force toward the second supporting portion 73B. Further, when the swash plate 50 is pressed at a high pressure toward the swash plate supporting member 70, a larger force is required to operate the swash plate 50 to tilt, resulting in a failure to achieve smooth tilting of the swash plate 50.

Meanwhile, as shown in FIG. 2 and FIG. 3, an oil reservoir portion C is formed between the swash plate 50 and the swash plate supporting member 70. The oil reservoir portion C communicates with a pressure oil introducing passage P. The pressure oil introducing passage P is a flow passage of a pressurized hydraulic oil. Accordingly, the oil reservoir portion C is filled with a pressure oil, namely, the pressurized hydraulic oil. Further, the pressure oil in the oil reservoir portion C presses the swash plate 50 in a direction away from the swash plate supporting member 70 in the axis direction da, in other words, in a direction toward the cylinder block 20 and the pistons 25 in the axis direction da. Moreover, an oil film is formed between the sliding surface 55 and the supporting surface 75, and thus it is also possible to avoid direct frictional contact between the supporting portion 73 and the supported portion 53. As an effect obtained by supplying the pressure oil into the oil reservoir portion C, it is possible to reduce friction between the swash plate 50 and the swash plate supporting member 70. Thus, it is possible to achieve smooth tilting of the swash plate 50 by the tilt adjustment mechanism 35.

In the example shown, as the pressure oil introducing passage P, a first introducing passage Pa and a second introducing passage Pb are formed in the hydraulic system 10. The first introducing passage Pa includes a swash plate through hole Pa1 (see FIG. 2 and FIG. 3) and a piston through hole Pa2 (see FIG. 1). The swash plate through hole Pa1 penetrates the swash plate 50 through the first supported portion 53A, and the piston through hole Pa2 penetrates each of the pistons 25. As the cylinder block 20 rotates, each of the pistons 25 passes above the swash plate through hole Pa1 open on the principal surface 52 of the swash plate 50, and at this time, the first introducing passage Pa establishes communication between the oil reservoir portion C and a corresponding one of the cylinder chambers 21 filled with a high-pressure hydraulic oil. On the other hand, the second introducing passage Pb (see FIG. 2) is a flow passage formed in, for example, the case 15 and the swash plate supporting member 70 and establishes communication between the oil reservoir portion C and the high-pressure side first flow passage 11. The first introducing passage Pa communicates with, for example, an after-mentioned first concave portion 60 of the oil reservoir portion C. The second introducing passage Pb communicates with, for example, an after-mentioned second concave portion 80 of the oil reservoir portion C. Furthermore, though not shown, a passage for establishing communication between the first concave portion 60 and the second concave portion 80 may be provided between the first concave portion 60 and the second concave portion 80.

However, as has already been described in the section explaining the prior art, strength of a force required to cause the swash plate 50 to tilt is not constant and varies with a tilt of the swash plate 50. In a case where strength of a force with which the swash plate 50 is pressed by the pressure oil in the oil reservoir portion C in the direction away from the swash plate supporting member 70, on the other hand, is constant, there occurs deterioration in performance of the hydraulic system 10. Specifically, when a force with which the swash plate 50 is pressed by the pressure oil in the oil reservoir portion C is set to be low, in a case where a large force is required to cause the swash plate 50 to tilt, hysteresis occurs in horsepower characteristics of the hydraulic system 10, resulting in deterioration in performance of the hydraulic system 10. Conversely, when the force with which the swash plate 50 is pressed by the pressure oil in the oil reservoir portion C is set to be high, in a case where the use of a small force is sufficient for causing the swash plate 50 to tilt, the oil in the oil reservoir portion C might leak from between the swash plate 50 and the swash plate supporting member 70, causing deterioration in performance of the hydraulic system 10.

With the above in view, the hydraulic system 10 according to this embodiment is devised to solve this trouble so as to effectively suppress deterioration in performance of the hydraulic system 10 caused by a tilting operation of the swash plate 50. Specifically, an area of the oil reservoir portion C between the swash plate 50 and the swash plate supporting member 70 varies with a tilt of the swash plate 50, namely, the tilt angle θi. The area of the oil reservoir portion C refers to an opening area of the oil reservoir portion C on and along a plane of contact between the supported portion 53 of the swash plate 50 and the supporting portion 73 of the swash plate supporting member 70. In the example shown, the opening area of the oil reservoir portion C is an area in which the oil reservoir portion C is projected onto a curved surface expanding along the sliding surface 55 of the supported portion 53 and the supporting surface 75 of the supporting portion 72 (for example, along a circular arc).

In the hydraulic system 10, when the area of the oil reservoir portion C is increased, there is also increased a force with which the swash plate 50 is pressed by the pressure oil in the oil reservoir portion C in the direction away from the swash plate supporting member 70 along the axis direction da. In accordance therewith, it becomes likely that an oil film is formed between the sliding surface 55 of the swash plate 50 and the supporting surface 75 of the swash plate supporting member 70. Conversely, when the area of the oil reservoir portion C is decreased, there is also decreased a force with which the swash plate 50 is pressed by the pressure oil in the oil reservoir portion C in the direction away from the swash plate supporting member 70 along the axis direction da. In accordance therewith, it is possible to effectively prevent a large amount of pressure oil from leaking from between the sliding surface 55 of the swash plate 50 and the supporting surface 75 of the swash plate supporting member 70. In the hydraulic system 10 configured as above, the area of the oil reservoir portion C is made to vary with a variation in strength of a force required to cause the swash plate 50 to tilt, and thus it is possible to effectively suppress deterioration in performance of the hydraulic system 10 caused by a tilting operation of the swash plate 50.

In the example shown, as shown in FIG. 2 and FIG. 3, the oil reservoir portion C whose area is variable is provided between the first supported portion 53A of the swash plate 50 and the first supporting portion 73A of the swash plate supporting member 70, the first supported portion 53A being pressed at a high pressure by the pistons 25, the first supporting portion 73A facing the first supported portion 53A. That is, the oil reservoir portion C whose area is variable is formed between the first supported portion 53A and the first supporting portion 73A on a high-pressure side.

In this example, as shown in FIG. 3, the first concave portion 60 is formed in the sliding surface 55 of the swash plate 50 facing the swash plate supporting member 70. The first concave portion 60 has a bottom surface expanding along the sliding surface 55. There is, however, no limitation to the example shown, and the bottom surface of the first concave portion 60 may be a flat surface instead of a curved surface or a bent surface including a plurality of flat surfaces or may include a curved surface and a flat surface. As shown in FIG. 3, the swash plate through hole Pa1 of the first introducing passage Pa is open in the first concave portion 60. Accordingly, the first introducing passage Pa can supply the pressure oil into the first concave portion 60. On the other hand, as shown in FIG. 2, the second concave portion 80 forming the oil reservoir portion C is formed in the supporting surface 75 of the swash plate supporting member 70 facing the swash plate 50. The second concave portion 80 has a bottom surface expanding along the supporting surface 75. The second introducing passage Pb is open in the second concave portion 80. Accordingly, the second introducing passage Pb can supply the pressure oil into the second concave portion 80. Further, the first concave portion 60 and the second concave portion 80 form the oil reservoir portion C between the first supported portion 53A of the swash plate 50 and the first supporting portion 73A of the swash plate supporting member 70.

An area of the first concave portion 60 and an area of the second concave portion 80 are each constant without depending on a tilt of the swash plate 50. However, the first concave portion 60 is provided at a fixed position in the sliding surface 55, and the second concave portion 80 is provided at a fixed position in the supporting surface 75. Accordingly, as the swash plate 50 tilts, positions of the first concave portion 60 and the second concave portion 80 relative to each other vary. Further, in the example shown, an area of a region Z in which the first concave portion 60 and the second concave portion 80 overlap with each other varies with a tilt of the swash plate 50. The area of the oil reservoir portion C between the swash plate 50 and the swash plate supporting member 70 has a value obtained by subtracting the area of the region Z in which the first concave portion 60 and the second concave portion 80 overlap with each other between the swash plate 50 and the swash plate supporting member 70 from a sum of the area (an opening area) of the first concave portion 60 between the swash plate 50 and the swash plate supporting member 70 and the area (an opening area) of the second concave portion 80 between the swash plate 50 and the swash plate supporting member 70. Accordingly, as the area of the region Z in which the first concave portion 60 and the second concave portion 80 overlap with each other varies, the area of the oil reservoir portion C between the swash plate 50 and the swash plate supporting member 70 varies with a tilt of the swash plate 50.

Hereinafter, a plurality of specific examples related to the oil reservoir portion C will be described with reference mainly to FIG. 4 to FIG. 10. FIG. 4 to FIG. 10 show the positions of the first concave portion 60 and the second concave portion 80 relative to each other, the shape of the oil reservoir portion C, and a variation in area of the oil reservoir portion C, based on tilts of the swash plate 50. The positions of the first concave portion 60 and the second concave portion 80 relative to each other and the shape of the oil reservoir portion C are shown for a tilt state (a) as a largest tilt state shown in FIG. 1, a tilt state (c) as a smallest tilt state where the tilt angle θi is 0°, and a tilt state (b) as a state between the tilt state (a) and the tilt state (c). As for the variation in area of the oil reservoir portion C, variations occurring during a transition between the tilt state (a) and the tilt state (c) are plotted into a graph. Furthermore, in FIG. 4 to FIG. 10, the sliding surface 55 of the swash plate 50 and the supporting surface 75 of the swash plate supporting member 70 are shown in a planarly developed state.

First Example

First, a first example of the oil reservoir portion C will be described with reference to FIG. 4. In the example shown in FIG. 4, the first concave portion 60 formed in the sliding surface 55 extends in an elongated manner in a relative movement direction dm between the swash plate 50 and the swash plate supporting member 70. A length of the first concave portion 60 along the relative movement direction dm is significantly larger than a length of the second concave portion 80 along the relative movement direction dm. In the example shown in FIG. 4, a width of the first concave portion 60 in a direction orthogonal to the relative movement direction dm is constant and does not vary at various positions along the relative movement direction dm. Similarly, a width of the second concave portion 80 in the direction orthogonal to the relative movement direction dm is constant and does not vary at various positions along the relative movement direction dm.

In the tilt state (a) as the largest tilt state, the first concave portion 60 and the second concave portion 80 overlap with each other. In this case, however, the first concave portion 60 and the second concave portion 80 only partly overlap with each other. As the tilt angle θi is decreased from the largest tilt state (the tilt state (a)), the area of the region Z in which the first concave portion 60 and the second concave portion 80 overlap with each other is increased. In a state between the tilt state (a) and the tilt state (b), the second concave portion 80 overlaps, in its entire region, with the first concave portion 60. Then, in the tilt state (b) and the tilt state (c) as the smallest tilt state, the second concave portion 80 remains in the state of overlapping, in its entire region, with the first concave portion 60.

Figure 4:
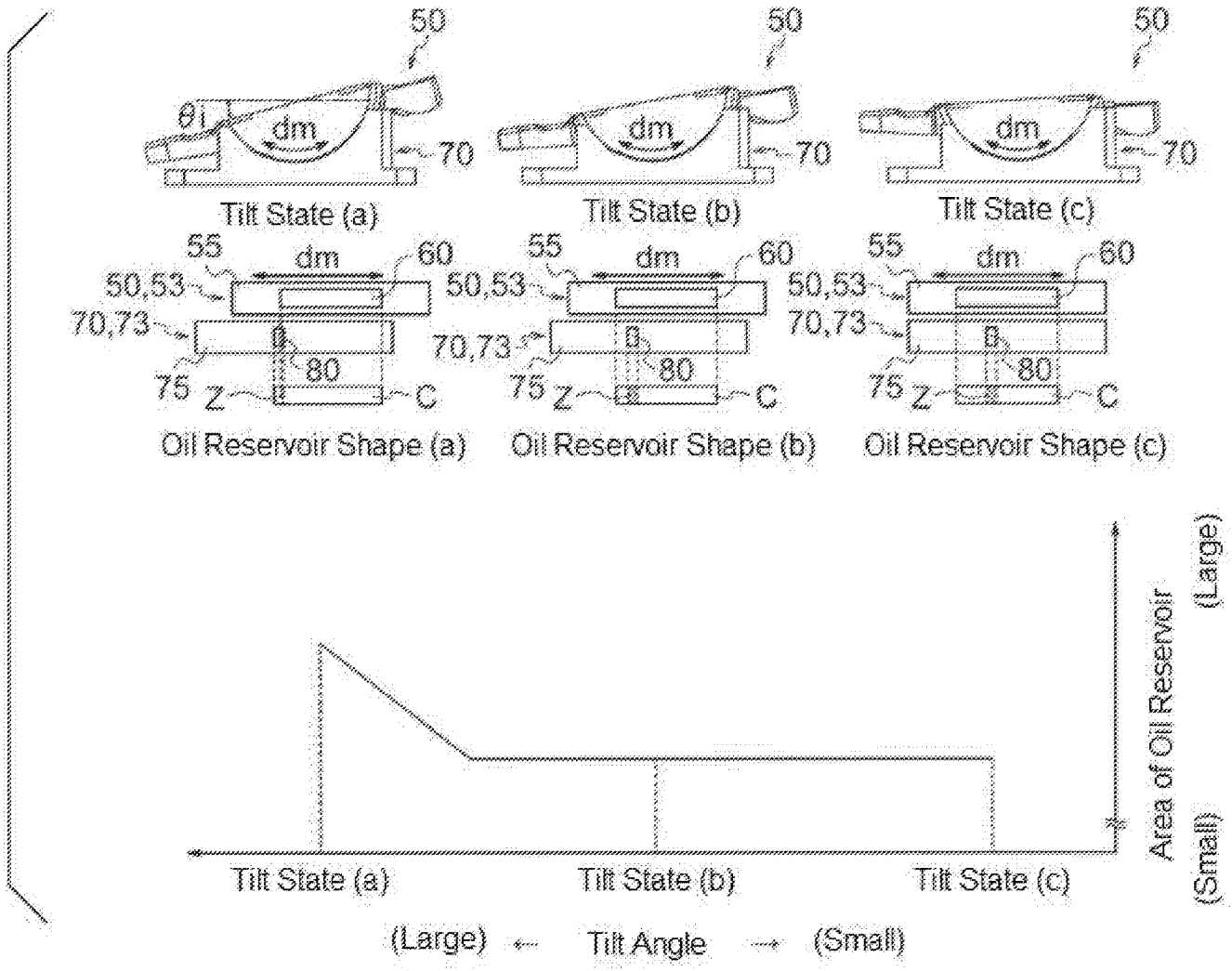
FIG. 4 is a view for explaining a first example of an oil reservoir portion formed between the swash plate and the swash plate supporting member.

As shown in FIG. 4, as the region Z in which the first concave portion 60 and the second concave portion 80 overlap with each other varies in this manner, the area of the oil reservoir portion C varies with the tilt angle θi. In the first example, in the tilt state (a) that is the largest tilt state, the area of the oil reservoir portion C is largest. While the tilt angle θi is decreased from the tilt state (a) to the state between the tilt state (a) and the tilt state (b), the area of the oil reservoir portion C is gradually decreased. Then, until the tilt state (c) that is the smallest tilt state is reached, regardless of a decrease in the tilt angle θi, the area of the oil reservoir portion C is constant and does not vary.

As described above, in the first example, the area of the oil reservoir portion C in the largest tilt state (the tilt state (a)) where the tilt angle θi of the swash plate 50 is largest is larger than the area of the oil reservoir portion C in an intermediate state (for example, the tilt state (b)) between the smallest tilt state (the tilt state (c)) where the tilt angle θi is smallest and the largest tilt state.

For example, at the start of tilting of the swash plate 50, the swash plate 50 held at a predetermined relative position to the swash plate supporting member 70 needs to be operated with a large force larger than a static frictional force far larger than a dynamic frictional force. As described above, in general, at the start of tilting of the swash plate 50, the control piston 39 of the swash plate control device 37 is not pressing the swash plate 50, and thus the swash plate 50 is maintained in a state of being pressed by the swash plate pressing member 36 so as to be inclined at a largest tilt angle. Therefore, when the swash plate 50 maintained at the largest tilt angle at the start of tilting of the swash plate 50 is caused to tilt, normally, a large force is required to operate the swash plate 50.

In this regard, in the first example, the area of the oil reservoir portion C in the largest tilt state is larger than the area of the oil reservoir portion C in the intermediate state and thus is not smallest. Particularly in the first example, the area of the oil reservoir portion C is largest or substantially largest in the largest tilt state. Accordingly, in a state where the swash plate 50 is in the largest tilt state, the swash plate 50 can be pressed with a strong force by the pressure oil in the oil reservoir portion C in the direction away from the swash plate supporting member 70. That is, in a case where a larger force is required to cause the swash plate 50 to tilt, a force with which the swash plate 50 is pressed by the pressure oil in the oil reservoir portion C in the direction away from the swash plate supporting member 70 can be made to vary to be increased Thus, it is possible to suppress occurrence of hysteresis in characteristics of the hydraulic system 10 (for example, horsepower characteristics in a hydraulic pump) and thus to more effectively avoid deterioration in performance of the hydraulic system 10.

As one specific example, in a case where the hydraulic system 10 is used as a hydraulic pump, normally, the hydraulic system 10 is subjected to horsepower control when there is a variation in pressure therein. In the horsepower control, a discharge pressure and a discharge flow rate of the hydraulic system 10 are suppressed so that an allowable torque of the input unit such as an engine is not exceeded, the input unit driving the hydraulic system 10 to rotate as the hydraulic pump. That is, in the horsepower control the swash plate 50 whose tilt has been large under a low pressure is caused to tilt so that the tilt angle θi thereof is decreased. At this time, the swash plate 50 being stationary relative to the swash plate supporting member 70 is caused to tilt, and thus it is required that a force sufficiently large to be able to oppose a static frictional force be applied to the swash plate 50. In this regard, according to the first example, the area of the oil reservoir portion C in the largest tilt state is larger than the area of the oil reservoir portion C in the intermediate state, and thus the swash plate 50 can be pressed with a large force by the pressure oil in the oil reservoir portion C in the direction away from the swash plate supporting member 70. Accordingly, the swash plate 50 can be operated smoothly in the horsepower control, and thus it is possible to effectively prevent noticeable hysteresis from occurring in the horsepower characteristics. Thus, the characteristics of the hydraulic system 10 can be enhanced by efficiently using an output from the input unit such as an engine.

Moreover, in the first example, the area of the oil reservoir portion C in the intermediate state between the largest tilt state and the smallest tilt state is smaller than the area of the oil reservoir portion C in the largest tilt state. As described above, there is a tendency that a larger force is required to cause the swash plate 50 to tilt when the swash plate 50 is maintained at the largest tilt angle. On the other hand, there is a tendency that a smaller force is required to cause the swash plate 50 to tilt when the swash plate 50 is in the intermediate state. In the first example, the area of the oil reservoir portion C in the intermediate state is smaller and is typically smallest. That is, in a case where a smaller force is required to cause the swash plate 50 to tilt, a force with which the swash plate 50 is pressed by the pressure oil in the oil reservoir portion C in the direction away from the swash plate supporting member 70 is decreased Thus, it is possible to suppress leakage of the pressure oil in the oil reservoir portion C from between the swash plate 50 and the swash plate supporting member 70 and thus to more effectively avoid deterioration in performance of the hydraulic system 10.

Second Example

Figure 5:
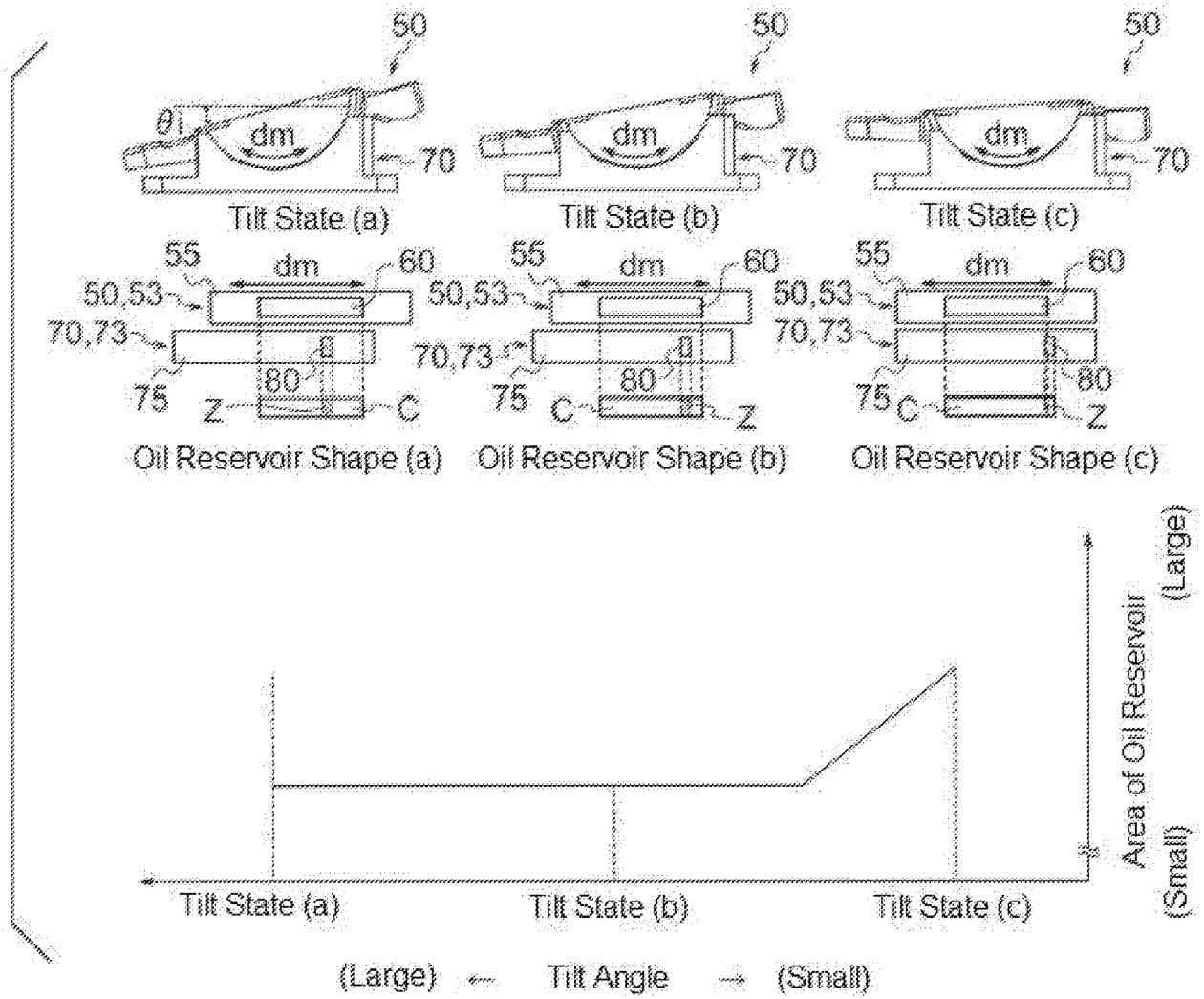
FIG. 5 is a view for explaining a second example of the oil reservoir portion formed between the swash plate and the swash plate supporting member.

Next, a second example of the oil reservoir portion C will be described with reference to FIG. 5. The example shown in FIG. 5 is different from the above-described first example in position of the second concave portion 80 in the supporting surface 75 of the swash plate supporting member 70 and can be the same as the first example in other respects. The following omits a duplicate description of the same configuration as in the first example and mainly describes a configuration different from that in the first example.

As shown in FIG. 5, in the tilt state (c) as the smallest tilt state, the first concave portion 60 and the second concave portion 80 overlap with each other. In this case, however, the first concave portion 60 and the second concave portion 80 only partly overlap with each other. As the tilt angle θi is increased from the smallest tilt state (the tilt state (c)), the area of the region Z in which the first concave portion 60 and the second concave portion 80 overlap with each other is increased. In a state between the tilt state (c) and the tilt state (b), the second concave portion 80 overlaps, in its entire region, with the first concave portion 60. Then, in the tilt state (b) and the tilt state (a) as the largest tilt state, the second concave portion 80 remains in the state of overlapping, in its entire region, with the first concave portion 60.

As shown in FIG. 5, in the second example, in the tilt state (c) that is the smallest tilt state, the area of the overlapping region Z is smallest, and thus the area of the oil reservoir portion C is largest. While the tilt angle θi is increased from the tilt state (c) to a state between the tilt state (b) and the tilt state (a), the area of the oil reservoir portion C is gradually decreased. Then, until the tilt state (a) that is the largest tilt state is reached, regardless of an increase in the tilt angle θi, the area of the oil reservoir portion C is constant and does not vary.

As described above, in the second example, the area of the oil reservoir portion C in the smallest tilt state (the tilt state (c)) where the tilt angle θi of the swash plate 50 is smallest is larger than the area of the oil reservoir portion C in the intermediate state (for example, the tilt state (b)) between the largest tilt state (the tilt state (a)) where the tilt angle θi is largest and the smallest tilt state.

For example, depending on a configuration of the tilt adjustment mechanism 35, a force received by the swash plate 50 from the tilt adjustment mechanism 35 for adjusting a tilt of the swash plate 50 varies with the tilt of the swash plate 50. As is often the case with the hydraulic system 10, the tilt angle θi of the swash plate 50 is decreased by using the swash plate control device 37 to press the swash plate 50 against a pressing force of the swash plate pressing member 36. When contracted, the swash plate pressing member 36 has increased resilience. As a consequence, typically, the swash plate 50 maintained at a smallest tilt angle is pressed toward the swash plate supporting member 70 with an extremely large force by the tilt adjustment mechanism 35. Therefore, when the swash plate 50 maintained at the smallest tilt angle is caused to tilt, normally, a large force is required to operate the swash plate 50.

In this regard, in the second example, the area of the oil reservoir portion C in the smallest tilt state is larger than the area of the oil reservoir portion C in the intermediate state and thus is not smallest. Particularly in the second example, the area of the oil reservoir portion C is largest or substantially largest in the smallest tilt state. Accordingly, in a state where the swash plate 50 is in the smallest tilt state, the swash plate 50 is pressed with a strong force by the pressure oil in the oil reservoir portion C in the direction away from the swash plate supporting member 70. That is, in a case where a larger force is required to cause the swash plate 50 to tilt, a force with which the swash plate 50 is pressed by the pressure oil in the oil reservoir portion C in the direction away from the swash plate supporting member 70 can be made to vary to be increased Thus, it is possible to suppress occurrence of hysteresis in characteristics of the hydraulic system 10 (for example, horsepower characteristics in a hydraulic pump) and thus to more effectively avoid deterioration in performance of the hydraulic system 10.

As one specific example, the hydraulic system 10 as a hydraulic pump is subjected to negative flow control based on an external sensor. The external sensor is capable of detecting an increase in amount of the pressure oil returning to the tank without being supplied to an actuator or the like connected to a hydraulic circuit. In the negative flow control upon detection of an increase in flow rate by the external sensor, the swash plate 50 is maintained in the smallest tilt state or a state where the tilt angle θi is extremely small. The swash plate 50 is then pressed toward the swash plate supporting member 70 with a strong force from the tilt adjustment mechanism 35, and thus causing the swash plate 50 to tilt requires that a large force be applied to the swash plate 50. In this regard, according to the second example, the area of the oil reservoir portion C in the smallest tilt state is larger than the area of the oil reservoir portion C in the intermediate state, and thus the swash plate 50 can be pressed with a large force by the pressure oil in the oil reservoir portion C in the direction away from the swash plate supporting member 70. Accordingly, the swash plate 50 can be operated smoothly in the negative flow control, and thus it is possible to effectively prevent noticeable hysteresis from occurring in absorbing horsepower characteristics.

Moreover, in the second example, the area of the oil reservoir portion C in the intermediate state between the largest tilt state and the smallest tilt state is smaller than the area of the oil reservoir portion C in the smallest tilt state. As described above, there is a tendency that a larger force is required to cause the swash plate 50 to tilt when the swash plate 50 is maintained at the smallest tilt angle. On the other hand, there is a tendency that a smaller force is required to cause the swash plate 50 to tilt when the swash plate 50 is in the intermediate state. In the second example, the area of the oil reservoir portion C in the intermediate state is smaller and is typically smallest. That is, in a case where a smaller force is required to cause the swash plate 50 to tilt, a force with which the swash plate 50 is pressed by the pressure oil in the oil reservoir portion C in the direction away from the swash plate supporting member 70 is decreased Thus, it is possible to suppress leakage of the pressure oil in the oil reservoir portion C from between the swash plate 50 and the swash plate supporting member 70 and thus to more effectively avoid deterioration in performance of the hydraulic system 10.

Third Example

Next, a third example of the oil reservoir portion C will be described with reference to FIG. 6. In the example shown in FIG. 6, in the supporting surface 75 of the swash plate supporting member 70, a plurality of second concave portions 80 are formed so as to be spaced from each other in the relative movement direction dm. The third example is different in this respect from the first example and the second example and can be the same as the first example or the second example in other respects. By providing the plurality of second concave portions 80 spaced from each other as described above, the degree of freedom in arrangement of the oil reservoir portion C is improved, the oil reservoir portion C being formed by the first concave portion 60 and the second concave portions 80, and a plurality of oil reservoir portions C can be dispersedly arranged between a single pair of the supporting portion 73 of the swash plate supporting member 70 and the supported portion 53 of the swash plate 50. Furthermore, the oil reservoir portion C can also be disposed so as to be able to press the swash plate 50 substantially along the axis direction da, and thus also from this viewpoint, it is possible to achieve smooth tilting of the swash plate 50.

Figure 6:
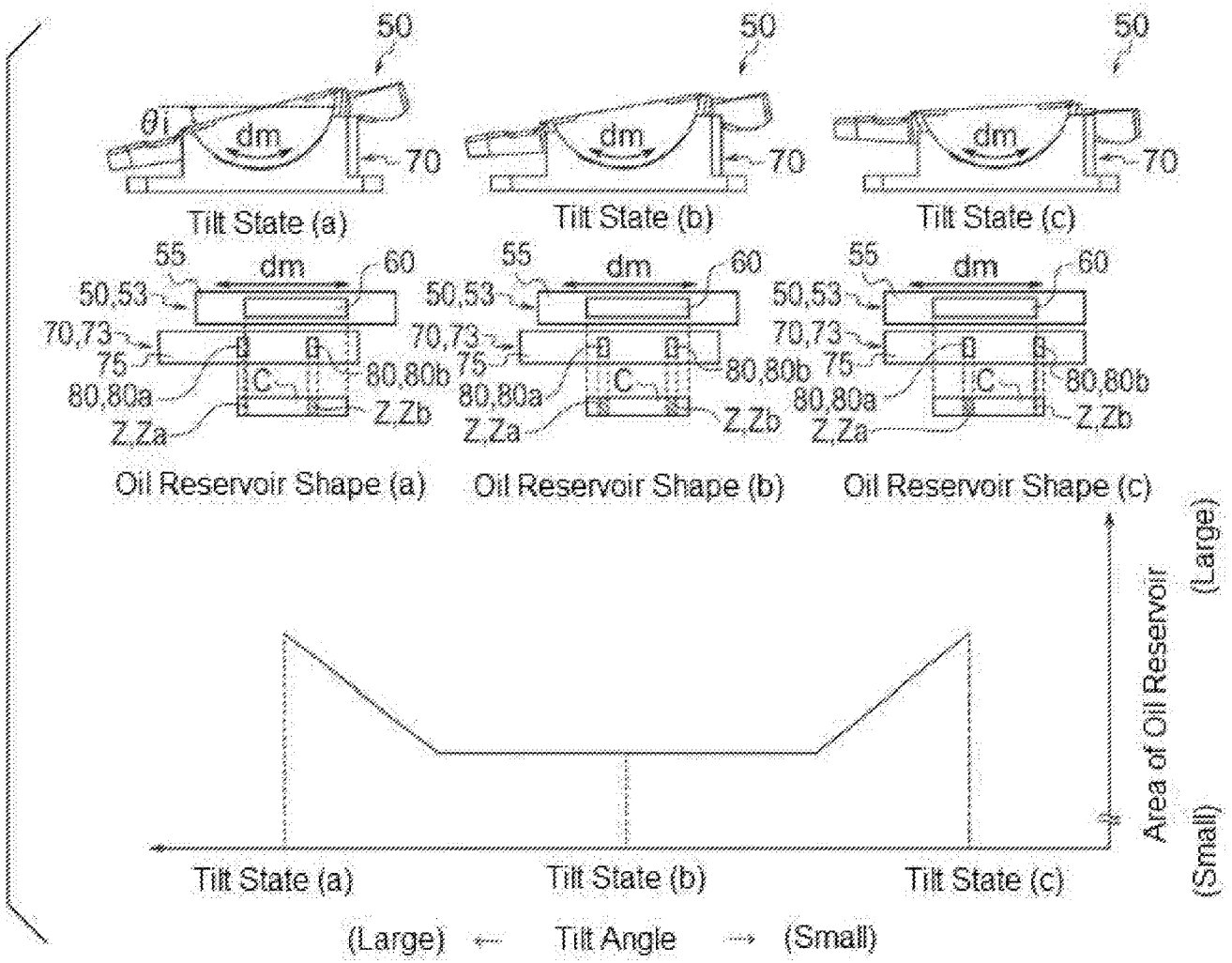
FIG. 6 is a view for explaining a third example of the oil reservoir portion formed between the swash plate and the swash plate supporting member.

As shown in FIG. 6, the second concave portions 80 include a one-side second concave portion 80*a* and an other-side second concave portion 80*b* spaced from each other along the relative movement direction dm. In the specific example shown in FIG. 6, the one-side second concave portion 80*a* has the same configuration as that of the second concave portion 80 in the above-described first example, and the other-side second concave portion 80*b* has the same configuration as that of the second concave portion 80 in the above-described second example.

Accordingly, in the tilt state (a) as the largest tilt state, the first concave portion 60 and the one-side second concave portion 80*a* only partly overlap with each other. As the tilt angle θi is decreased from the largest tilt state (the tilt state (a)), an area of a region Za in which the first concave portion 60 and the one-side second concave portion 80*a* overlap with each other is increased. In a state between the tilt state (a) and the tilt state (b), the one-side second concave portion 80*a* overlaps, in its entire region, with the first concave portion 60. Then, in the tilt state (b) and the tilt state (c) as the smallest tilt state, the one-side second concave portion 80*a* remains in the state of overlapping, in its entire region, with the first concave portion 60.

On the other hand, in the tilt state (c) as smallest tilt state, the first concave portion 60 and the other-side second concave portion 80*b* only partly overlap with each other. As the tilt angle θi is increased from the smallest tilt state (the tilt state (c)), an area of a region Zb in which the first concave portion 60 and the other-side second concave portion 80*b* overlap with each other is increased. In a state between the tilt state (c) and the tilt state (b), the other-side second concave portion 80*b* overlaps, in its entire region, with the first concave portion 60. Then, in the tilt state (b) and the tilt state (a) as the largest tilt state, the other-side second concave portion 80*b* remains in the state of overlapping, in its entire region, with the first concave portion 60.

As shown in FIG. 6, as the region Z in which the first concave portion 60 and each of the second concave portions 80 overlap with each other varies in this manner, the area of the oil reservoir portion C varies with the tilt angle θi. In the third example, in the tilt state (a) that is the largest tilt state, the area of the oil reservoir portion C is maximum or largest. While the tilt angle θi is decreased from the tilt state (a) to the state between the tilt state (a) and the tilt state (b), the area of the oil reservoir portion C is gradually decreased. Then, until the state between the tilt state (b) and the tilt state (c) is reached, regardless of a decrease in the tilt angle θi, the area of the oil reservoir portion C is smallest and constant and does not vary. As the tilt angle θi is decreased further, the area of the oil reservoir portion C is gradually increased. Further, in the tilt state (c) that is the smallest tilt state, the area of the oil reservoir portion C is maximum or largest.

According to the above-described example, the advantageous effect described in the first example and the advantageous effect described in the second example can be both achieved, and thus it is possible to even more effectively avoid deterioration in performance of the hydraulic system 10.

Fourth Example

Next, a fourth example of the oil reservoir portion C will be described with reference to FIG. 7. In the example shown in FIG. 7, the first concave portion 60 and the second concave portions 80 are spaced apart from each other in accordance with a tilt of the swash plate 50. The fourth example is different in this respect from the first to third examples in which the first concave portion 60 and the second concave portion(s) 80 at least partly overlap with each other during a transition between the smallest tilt state and the largest tilt state and can be the same as the first to the third examples in other respects. According to the fourth example described above, the degree of freedom in arrangement of the oil reservoir portion C is improved, the oil reservoir portion C being formed by the first concave portion 60 and the second concave portions 80, and a plurality of oil reservoir portions C can be dispersedly arranged between a single pair of the supporting portion 73 of the swash plate supporting member 70 and the supported portion 53 of the swash plate 50. Furthermore, the oil reservoir portion C can also be disposed so as to be able to press the swash plate 50 substantially along the axis direction da, and thus also from this viewpoint, it is possible to achieve smooth tilting of the swash plate 50. Moreover, it is also possible to maintain the area of the oil reservoir portion C at a largest value or a maximum value while the tilt angle θi varies by a predetermined angle value.

Figure 7:
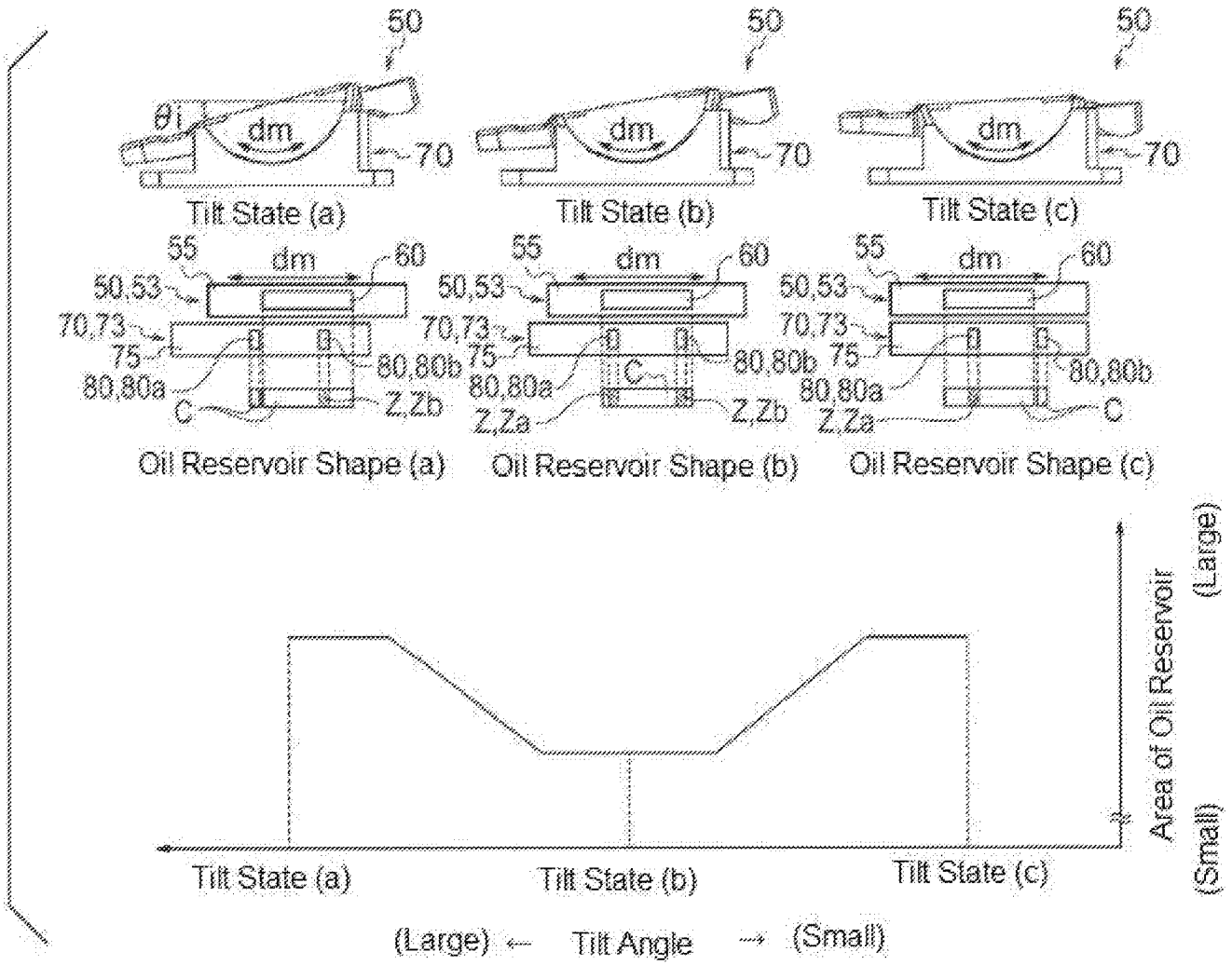
FIG. 7 is a view for explaining a fourth example of the oil reservoir portion formed between the swash plate and the swash plate supporting member.

As shown in FIG. 7, the second concave portions 80 include a one-side second concave portion 80*a* and an other-side second concave portion 80*b* spaced from each other along the relative movement direction dm. The one-side second concave portion 80*a* in the specific example shown in FIG. 7 has the same configuration as that of the one-side second concave portion 80*a* in the above-described third example except for a disposition position thereof. Furthermore, the other-side second concave portion 80*b* in the specific example shown in FIG. 7 has the same configuration as that of the other-side second concave portion 80*b* in the above-described third example except for a disposition position thereof.

As shown in FIG. 7, in the tilt state (a) as the largest tilt state, the one-side concave portion 80*a* is out of alignment with the first concave portion 60 in the relative movement direction dm and does not overlap therewith. On the other hand, in the tilt state (a), the other-side second concave portion 80*b* overlaps, in its entire region, with the first concave portion 60. As the tilt angle θi is decreased from the largest tilt state, the one-side second concave portion 80*a* starts to overlap with the first concave portion 60. As the tilt angle θi is decreased further, the area of the region Za in which the first concave portion 60 and the one-side second concave portion 80*a* overlap with each other is gradually increased. In a state between the tilt state (a) and the tilt state (b), the one-side second concave portion 80*a* overlaps, in its entire region, with the first concave portion 60. Then, while the tilt angle θi is decreased to reach the tilt state (c) that is the smallest tilt state, the one-side second concave portion 80*a* is maintained in the state of overlapping, in its entire region, with the first concave portion 60.

On the other hand, while the tilt angle θi is decreased from the tilt state (a) to a state between the tilt state (b) and the tilt state (c), the other-side second concave portion 80*b* is maintained in the state of overlapping, in its entire region, with the first concave portion 60. Accordingly, during this period, the area of the region Zb in which the first concave portion 60 and the other-side second concave portion 80*b* overlap with each other is constant. As a result, while a state continues in which the tilt angle θi is within a given range of angle values, the state including the tilt state (b), the area of the region Z in which the first concave portion 60 and the second concave portion 80 overlap with each other is maintained constant.

When the tilt angle θi is decreased further, the other-side second concave portion 80*b* only partly overlaps with the first concave portion 60. When the tilt angle θi is decreased even further, the other-side second concave portion 80*b* is situated out of alignment with the first concave portion 60 in the relative movement direction dm and does not overlap therewith.

In the example shown in FIG. 7, while a state continues in which the tilt angle θi is within a given range of angle values, the state including the tilt state (a) as the largest tilt state, the area of the oil reservoir portion C is maintained largest or maximum. Further, as the tilt angle θi is decreased, the area of the oil reservoir portion C becomes smallest or minimum. Similarly, in the example shown in FIG. 7, while a state continues in which the tilt angle θi is within a given range of angle values, the state including the tilt state (c) as the smallest tilt state, the area of the oil reservoir portion C is maintained largest or maximum. Further, as the tilt angle θi is increased, the area of the oil reservoir portion C becomes smallest or minimum. Furthermore, in the example shown in FIG. 7, while a state continues in which the tilt angle θi is within a given range of angle values, the state including the tilt state (b), the area of the oil reservoir portion C is maintained smallest or minimum.

That is, the variation in area of the oil reservoir portion C in the fourth example shown in FIG. 7 is different from the variation in area of the oil reservoir portion C in the above-described third example in that the area of the oil reservoir portion C is maintained largest or maximum and constant in a vicinity of the tilt state (a) and maintained largest or maximum and constant in a vicinity of the tilt state (c). According also to the fourth example described above, it is possible to achieve a similar advantageous effect to that in the third example.

Fifth Example

Next, a fifth example of the oil reservoir portion C will be described with reference to FIG. 8. In the example shown in FIG. 8, in addition to the first concave portion 60, the second concave portion 80 also extends in an elongated manner in the relative movement direction dm in which the swash plate 50 and the swash plate supporting member 70 move relative to each other. The fifth example is different in this respect from the above-described first to fourth examples and can be the same as any one of the first to fourth examples in other respects.

Figure 8:
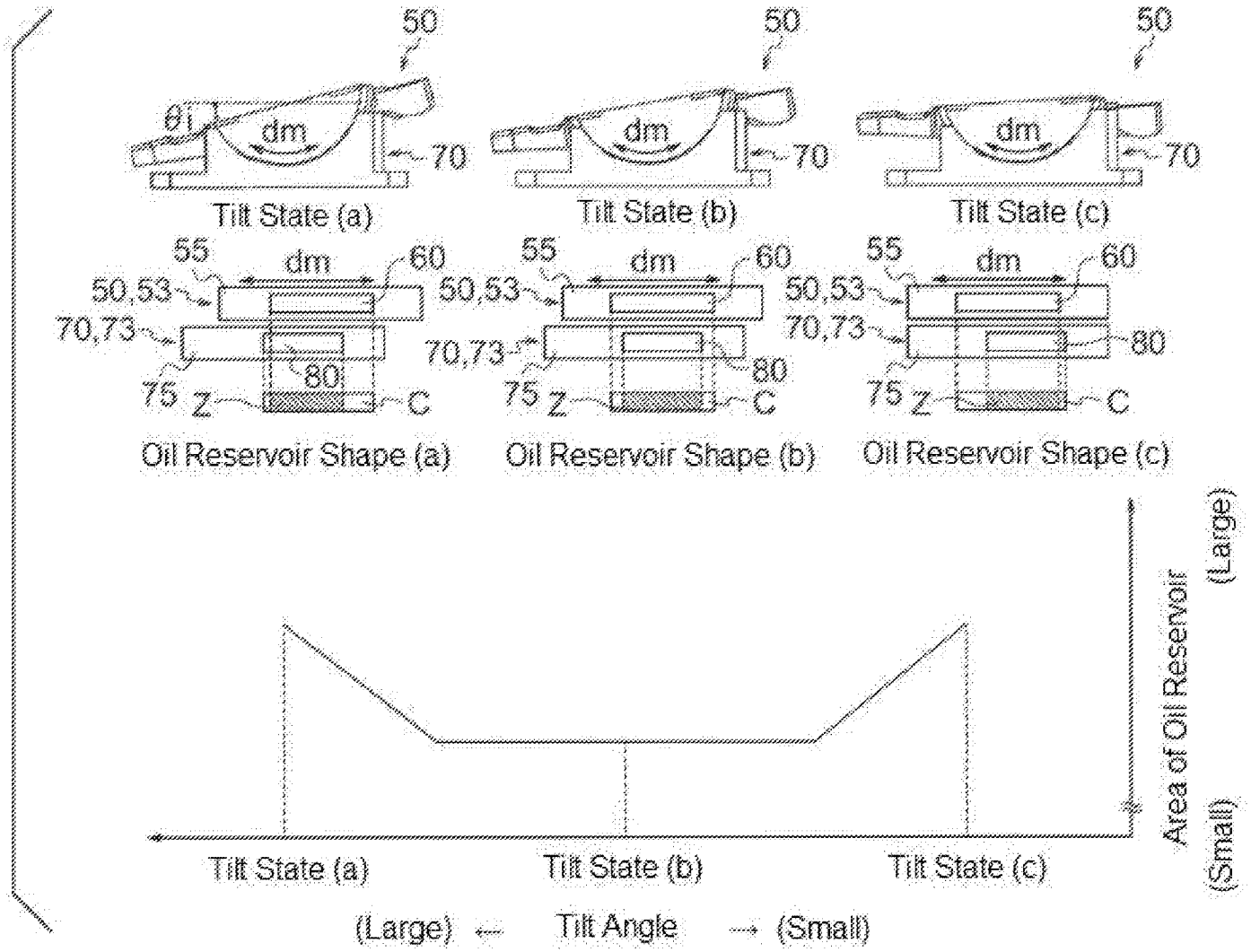
FIG. 8 is a view for explaining a fifth example of the oil reservoir portion formed between the swash plate and the swash plate supporting member.

In the example shown in FIG. 8, in the supporting surface 75, the second concave portion 80 is formed to extend over regions in which the one-side second concave portion 80*a* and the other-side second concave portion 80*b* are disposed, respectively, in the above-described third example and a region between the one-side second concave portion 80*a* and the other-side second concave portion 80*b* in the third example. In a similar manner to that of the area of the oil reservoir portion C in the above-described third example, the area of the oil reservoir portion C in the fifth example shown in FIG. 8 varies with a variation in tilt of the swash plate 50. As a consequence, according also to the fifth example described above, it is possible to achieve a similar advantageous effect to that in the third example.

While in the fifth example, a length of the second concave portion 80 along the relative movement direction dm is smaller than a length of the first concave portion 60 along the relative movement direction dm, there is no limitation thereto. The length of the second concave portion 80 along the relative movement direction dm may be equal to the length of the first concave portion 60 along the relative movement direction dm. According also to such a modification example, it is possible to adjust the area of the oil reservoir portion C so that the area varies as appropriate with a variation in tilt of the swash plate 50. For example, the area of the oil reservoir portion C can also be made to vary in a similar manner to the area of the oil reservoir portion C in the above-described third example.

Sixth Example

Next, a sixth example of the oil reservoir portion C will be described with reference to FIG. 9. In the example shown in FIG. 9, a length of the second concave portion 80 along the relative movement direction dm is larger than a length of the first concave portion 60 along the relative movement direction dm. The sixth example is different in this respect from the above-described first to fifth examples and can be the same as any one of the first to fifth examples in other respects.

Figure 9:
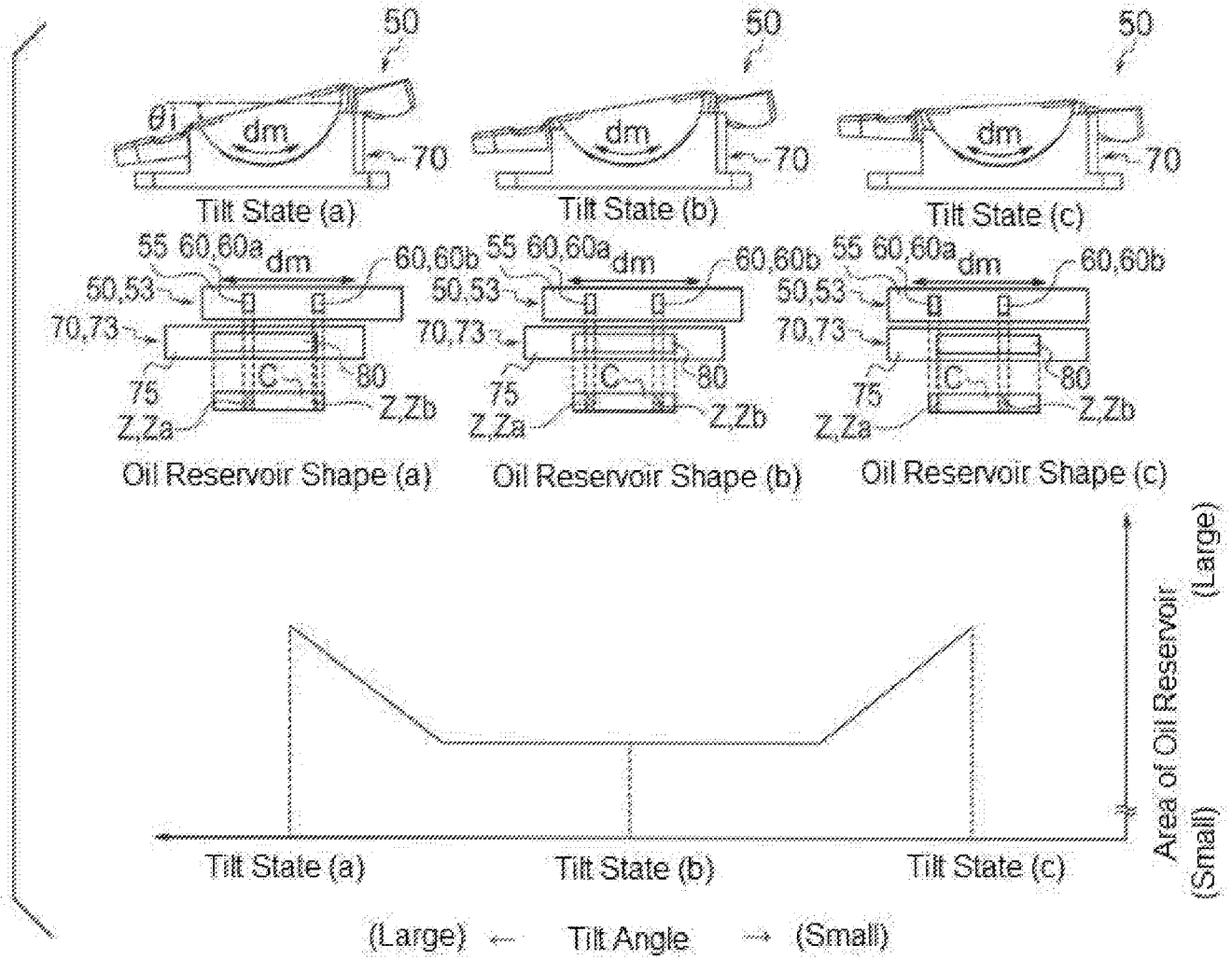
FIG. 9 is a view for explaining a sixth example of the oil reservoir portion formed between the swash plate and the swash plate supporting member.

In the example shown in FIG. 9, the first concave portion 60 has the same configuration as that of the second concave portions 80 in the above-described third example. Accordingly, the first concave portion 60 includes a one-side first concave portion 60*a* and an other-side first concave portion 60*b*. The second concave portion 80 has the same configuration as that of the first concave portion 60 in the third example. Accordingly, in a similar manner to the area of the oil reservoir portion C in the above-described third example, the area of the oil reservoir portion C in the sixth example shown in FIG. 9 varies with a variation in tilt of the swash plate 50. According also to the sixth example described above, it is possible to achieve a similar advantageous effect to that in the third example.

Seventh Example

Next, a seventh example of the oil reservoir portion C will be described with reference to FIG. 10. In the seventh example, a width of at least one of the first concave portion 60 and the second concave portion 80 in a direction orthogonal to the relative movement direction dm is not constant and varies at various positions along the relative movement direction dm. According to the above-described example, a rate at which the area of the region Z in which the first concave portion 60 and the second concave portion 80 overlap with each other varies with a tilt of the swash plate 50 is not constant. As a result, as shown in FIG. 10, the rate of variation in area of the oil reservoir portion C with a tilt of the swash plate 50 is not constant and can be adjusted.

Figure 10:
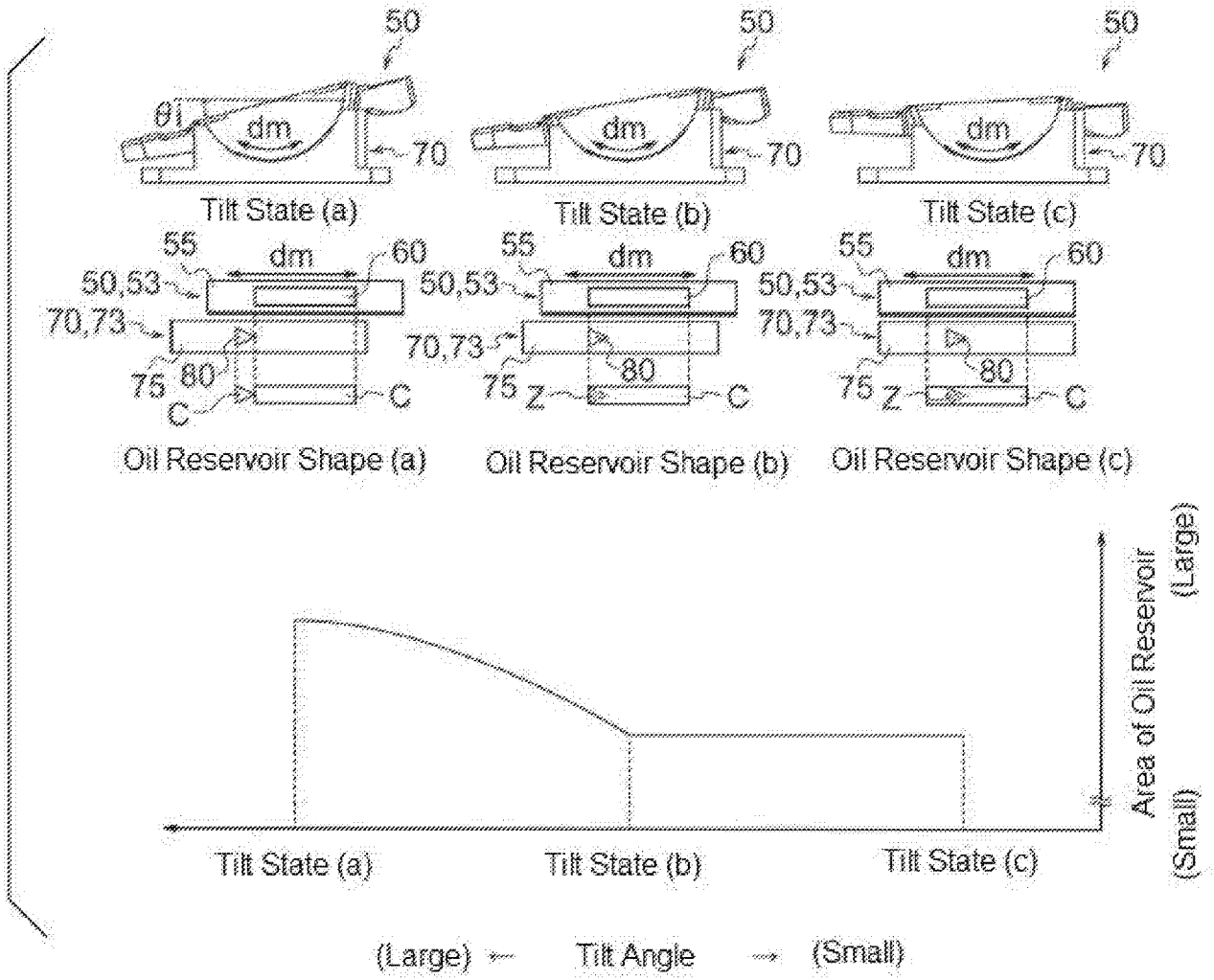
FIG. 10 is a view for explaining a seventh example of the oil reservoir portion formed between the swash plate and the swash plate supporting member.

The example shown in FIG. 10 is different from the above-described first example in configuration of the second concave portion 80 and can be the same as the first example in other respects. Specifically, the second concave portion 80 in the seventh example shown in FIG. 10 is different in shape from the second concave portion 80 in the first example. There is, however, no limitation thereto, and it is possible that a width of the first concave portion 60 varies or both of a width of the first concave portion 60 and a width of the second concave portion 80 vary.

In the embodiment discussed thus far, the hydraulic system 10 includes the pistons 25, the swash plate 50, and the swash plate supporting member 70. The swash plate 50 is opposed to the pistons 25 in the operational direction of the pistons 25. The swash plate supporting member 70 supports the swash plate 50 so that a tilt of the swash plate 50 is variable. The oil reservoir portion C communicating with the pressure oil introducing passage P is formed between the swash plate 50 and the swash plate supporting member 70. The area of the oil reservoir portion C between the swash plate 50 and the swash plate supporting member 70 varies with a tilt of the swash plate 50.

Strength of a force required to cause the swash plate to tilt is not constant and varies with a tilt of the swash plate 50. Further, when, although a large force is required to cause the swash plate 50 to tilt, a force with which the swash plate 50 is pressed by the pressure oil in the oil reservoir portion C in the direction away from the swash plate supporting member 70 is set to be low, smooth tilting of the swash plate 50 cannot be achieved. At this time, hysteresis occurs in characteristics of the hydraulic system 10 (for example, horsepower characteristics in a hydraulic pump), resulting in deterioration in performance of the hydraulic system 10. Conversely, when, although a small force is sufficient as a force required to cause the swash plate 50 to tilt, a force with which the swash plate 50 is pressed by the pressure oil in the oil reservoir portion C in the direction away from the swash plate supporting member 70 is set to be large, the oil in the oil reservoir portion C might leak from between the swash plate 50 and the swash plate supporting member 70, also causing deterioration in performance of the hydraulic system 10 (for example, volume efficiency in a hydraulic pump).

To address this trouble, in the embodiment discussed above, as the area of the oil reservoir portion C between the swash plate 50 and the swash plate supporting member 70 varies, a force with which the pressure oil housed in the oil reservoir portion C presses the swash plate 50 away from the swash plate supporting member 70 can also be made to vary with a tilt of the swash plate 50. Accordingly, in a case where a larger force is required to cause the swash plate 50 to tilt, a force with which the swash plate 50 is pressed by the pressure oil in the oil reservoir portion C in the direction away from the swash plate supporting member 70 is made to vary to be increased. With this configuration, it is possible to suppress occurrence of hysteresis in characteristics of the hydraulic system 10 (for example, horsepower characteristics in a hydraulic pump) and thus to effectively avoid deterioration in performance of the hydraulic system 10. Furthermore, in a case where a smaller force is required to cause the swash plate 50 to tilt, a force with which the swash plate 50 is pressed by the pressure oil in the oil reservoir portion C in the direction away from the swash plate supporting member 70 is also made to vary to be decreased With this configuration, it is possible to effectively prevent the pressure oil in the oil reservoir portion C from leaking from between the swash plate 50 and the swash plate supporting member 70. Thus, it is possible to effectively avoid deterioration in performance of the hydraulic system 10 (for example, deterioration in volume efficiency in a hydraulic pump). Based on the foregoing, according to this embodiment, it is possible to effectively suppress deterioration in performance of the hydraulic system 10 caused by a tilting operation of the swash plate 50.

Furthermore, in the above-described specific example, the first concave portion 60 is formed in the surface 55 of the swash plate 50 facing the swash plate supporting member 70, the first concave portion 60 forming the oil reservoir portion C, and the second concave portion 80 is formed in the surface 75 of the swash plate supporting member 70 facing the swash plate 50, the second concave portion 80 forming the oil reservoir portion C. The area of the first concave portion 60 and the area of the second concave portion 80, the first concave portion 60 and the second concave portion 80 forming the oil reservoir portion C, are each constant without depending on a tilt of the swash plate 50. On the other hand, the area of the region Z in which the first concave portion 60 and the second concave portion 80 overlap with each other varies with a tilt of the swash plate 50. In this example, the area of the oil reservoir portion C varies with a tilt of the swash plate 50. The area of the oil reservoir portion C is represented as a value obtained by subtracting the area of the region Z between the swash plate 50 and the swash plate supporting member 70, in which the first concave portion 60 and the second concave portion 80 overlap with each other, from a sum of the area of the first concave portion 60 and the area of the second concave portion 80 between the swash plate 50 and the swash plate supporting member 70. According to the first concave portion 60 and the second concave portion 80, the area of the oil reservoir portion C can be made to vary with a tilt of the shaft plate 50 by using a simple configuration.

While the foregoing has described the embodiment by using a plurality of specific examples, these specific examples are not intended to limit the embodiment. The foregoing embodiment can be implemented in various other specific forms and is susceptible to omission, replacement, and modification of various elements thereof within the purport of the invention. Hereinafter, a modification example will be described.

The configurations of the first concave portion 60 and the second concave portion 80, more specifically, the arrangements, shapes, numbers, or the like thereof can be changed as appropriate. For example, the planar shape of at least one of the first concave portion 60 and the second concave portion 80 may be, for example, circular, elliptical, triangular, or polygonal. Furthermore, the width of the first concave portion 60 may be larger than the width of the second concave portion 80, or the width of the first concave portion 60 may be smaller than the width of the second concave portion 80.

Furthermore, in the above-described specific example of the hydraulic system 10, the oil reservoir portion C whose area is variable is provided between the first supported portion 53A of the swash plate 50 and the first supporting portion 73A of the swash plate supporting member 70, the first supported portion 53A being pressed at a high pressure by the pistons 25, the first supporting portion 73A facing the first supported portion 53A. That is, the oil reservoir portion C whose area is variable is formed between the first supported portion 53A and the first supporting portion 73A on the high-pressure side. It is also possible that in addition to the oil reservoir portion C described above, as shown in FIG. 3, a second oil reservoir portion C2 is formed between the second supported portion 53B and the second supporting portion 73B on a low-pressure side.

That is, the swash plate supporting member 70 includes the pair of supporting portions 73A and 73B spaced from each other, and the swash plate 50 includes the pair of supported portions 53A and 53B supported by the pair of supporting portions 73A and 73B of the swash plate supporting member 70, respectively. Further, it is possible that the oil reservoir portion C is formed between the supporting portion 73A as one of the pair of supporting portions 73A and 73B and the supported portion 53A as one of the pair of supported portions 53A and 53B, and the second oil reservoir portion C2 is formed between the other supporting portion 73B and the other supported portion 53B. According to the above-described example, in addition to the oil reservoir portion C formed between the first supporting portion 73A of the swash plate supporting member 70 and the first supported portion 53A of the swash plate 50 on the high-pressure side, the second oil reservoir portion C2 is also formed between the second supporting portion 73B of the swash plate supporting member 70 and the second supported portion 53B of the swash plate 50 on the low-pressure side. Thus, on both of the high-pressure side and the low-pressure side, the swash plate 50 can be pressed away from the swash plate supporting member 70. Consequently, the swash plate 50 can be pressed substantially along the axis direction da, and thus also from this viewpoint, it is possible to achieve smooth tilting of the swash plate 50.

The second oil reservoir portion C2 shown in FIG. 3 has a constant area regardless of the orientation of the shaft plate 50. However, it is also possible that the configuration of the oil reservoir portion C discussed above is adopted, i.e., an area of the second oil reservoir portion C2 between the swash plate 50 and the swash plate supporting member 70 varies with a tilt of the swash plate 50.

Furthermore, in this modification example, the area of the second oil reservoir portion C2 can be set to be smaller than the area of the oil reservoir portion C, the oil reservoir portion C being formed between the supporting portion 73A as one of the pair of supporting portions 73A and 73B and the supported portion 53A as one of the pair of supported portions 53A and 53B, the second oil reservoir portion C2 being formed between the other supporting portion 73B and the other supported portion 53B. According to the above-described example, a force to press the swash plate 50 on the high-pressure side away from the swash plate supporting member 70 can be made larger than a force to press the swash plate 50 on the low-pressure side away from the swash plate supporting member 70. Thus, the swash plate 50 can be pressed along the axis direction da with higher accuracy, and thus also from this viewpoint, it is possible to achieve smoother tilting of the swash plate 50.

Another modification example will now be described. While the above-described specific example of the hydraulic system 10 shows an exemplary case in which the pressure oil introducing passage P includes the first introducing passage Pa communicating with the first concave portion 60 and the second introducing passage Pb communicating with the second concave portion 80, there is no limitation thereto. In a case where the first concave portion 60 and the second concave portion 80 are maintained in a state of communicating with each other regardless of a tilt of the swash plate 50, either one of the first introducing passage Pa and the second introducing passage Pb may be omitted.

In addition, as has already been described, the hydraulic system 10 is applicable to a hydraulic pump or a hydraulic motor, and such an application can effectively suppress deterioration in performance of the hydraulic system 10 caused by a tilting operation of the swash plate 50.

What is claimed is:

1. A hydraulic system, comprising:

a piston;

a swash plate opposed to the piston; and a swash plate supporting member configured to support the swash plate so that the swash plate is configured to tilt against the swash plate supporting member in a first direction and a tilt of the swash plate is variable, wherein at least one oil reservoir portion is provided between the swash plate and the swash plate supporting member, the at least one oil reservoir portion communicating with a pressure oil introducing passage, wherein an area of the at least one oil reservoir portion between the swash plate and the swash plate supporting member varies with the tilt of the swash plate, wherein a first concave portion is formed in a surface of the swash plate facing the swash plate supporting member, the first concave portion forming the at least one oil reservoir portion, the first concave portion extending in the first direction between a first wall and a second wall of the swash plate, the first concave portion being concaved inwardly from the surface of the swash plate, and wherein a second concave portion is formed in a surface of the swash plate supporting member facing the swash plate, the second concave portion forming the at least one oil reservoir portion, the second concave portion extending in the first direction between a third wall and a fourth wall of the swash plate supporting member, the second concave portion being concaved inwardly from the surface of the swash plate supporting member.

2. The hydraulic system according to claim 1, wherein an area of a region in which the first concave portion and the second concave portion overlap with each other varies with the tilt of the swash plate.

3. The hydraulic system according to claim 1, wherein an area of the at least one oil reservoir portion in a largest tilt state where a tilt angle of the swash plate is largest is larger than an area of the at least one oil reservoir portion in an intermediate state between a smallest tilt state where the tilt angle is smallest and the largest tilt state, the tilt angle of the swash plate being relative to a plane perpendicular to an operational direction of the piston.

4. The hydraulic system according to claim 1, wherein an area of the at least one oil reservoir portion in a smallest tilt state where a tilt angle of the swash plate is smallest is larger than an area of the at least one oil reservoir portion in an intermediate state between a largest tilt state where the tilt angle is largest and the smallest tilt state, the tilt angle of the swash plate being relative to a plane perpendicular to an operational direction of the piston.

5. The hydraulic system according to claim 1, wherein the swash plate supporting member includes a pair of supporting portions spaced from each other, wherein the swash plate includes a pair of supported portions supported by the pair of supporting portions of the swash plate supporting member, respectively, wherein the at least one oil reservoir portion comprises a first oil reservoir portion and a second oil reservoir portion, wherein the first oil reservoir portion is formed between one of the pair of supporting portions and one of the pair of supported portions, and wherein the second oil reservoir portion is formed between the other of the pair of supporting portions and the other of the pair of supported portions.

6. The hydraulic system according to claim 5, wherein an area of the first oil reservoir portion formed between the one of the pair of supporting portions and the one of the pair of supported portions is smaller than an area of the second oil reservoir portion formed between the other of the pair of supporting portions and the other of the pair of supported portions.

7. The hydraulic system according to claim 1, wherein the first concave portion and the second concave portion are spaced apart from each other in accordance with the tilt of the swash plate.

8. A hydraulic system, comprising:

a piston, a swash plate opposed to the piston; and a swash plate supporting member configured to support the swash plate so that the swash plate is configured to tilt against the swash plate supporting member in a first direction and a tilt of the swash plate is variable, the swash plate supporting member including a second concave portion provided so that an area of a region in which the second concave portion overlaps with a first concave portion varies with the tilt of the swash plate, the first concave portion being provided in the swash plate, wherein the first concave portion is formed in a surface of the swash plate facing the swash plate supporting member, the first concave portion extending in the first direction between a first wall and a second wall of the swash plate, the first concave portion being concaved inwardly from the surface of the swash plate, and wherein the second concave portion is formed in a surface of the swash plate supporting member facing the swash plate, the second concave portion extending in the first direction between a third wall and a fourth wall of the swash plate supporting member, the second concave portion being concaved inwardly from the surface of the swash plate supporting member.

* * * * *